US010358880B2

(12) United States Patent
Metcalf et al.

(10) Patent No.: US 10,358,880 B2
(45) Date of Patent: Jul. 23, 2019

(54) PIPE STORAGE BOX

(71) Applicant: The Charles Machine Works, Inc., Perry, OK (US)

(72) Inventors: Max Allen Metcalf, Stillwater, OK (US); Rick G. Porter, Perry, OK (US)

(73) Assignee: The Charles Machine Works, Inc., Perry, OK (US)

( * ) Notice: Subject to any disclaimer, the term of this patent is extended or adjusted under 35 U.S.C. 154(b) by 186 days.

(21) Appl. No.: 15/437,865

(22) Filed: Feb. 21, 2017

(65) Prior Publication Data

US 2017/0159379 A1 Jun. 8, 2017

Related U.S. Application Data

(63) Continuation-in-part of application No. PCT/US2015/051976, filed on Sep. 24, 2015.

(60) Provisional application No. 62/054,796, filed on Sep. 24, 2014.

(51) Int. Cl.

| | |
|---|---|
| ***E21B 19/14*** | (2006.01) |
| ***E21B 19/15*** | (2006.01) |
| ***E21B 7/02*** | (2006.01) |
| ***E21B 7/26*** | (2006.01) |
| ***E21B 19/08*** | (2006.01) |

(52) U.S. Cl.

CPC ..... *E21B 19/14* (2013.01); *E21B 7/02* (2013.01); *E21B 7/26* (2013.01); *E21B 19/08* (2013.01); *E21B 19/15* (2013.01)

(58) Field of Classification Search

CPC ..... E21B 19/14; E21B 19/15

See application file for complete search history.

(56) References Cited

U.S. PATENT DOCUMENTS

| | | | | |
|---|---|---|---|---|
| 6,179,065 | B1 * | 1/2001 | Payne | E21B 19/15 175/24 |
| 6,360,830 | B1 * | 3/2002 | Price | E21B 19/15 166/85.1 |
| 9,127,518 | B1 * | 9/2015 | Sewell | E21B 19/20 |
| 2001/0022238 | A1 | 9/2001 | Houwelingen et al. | |

(Continued)

FOREIGN PATENT DOCUMENTS

| | | | |
|---|---|---|---|
| WO | 2007041822 | A1 | 4/2007 |

OTHER PUBLICATIONS

Korean Intellectual Property Office "PCT International Search Report" dated Nov. 17, 2015, 3 pages, Republic of Korea.

*Primary Examiner* — Giovanna C Wright

(74) *Attorney, Agent, or Firm* — Tomlinson McKinstry, P.C.

(57) ABSTRACT

A pipe handling device and method for use with a horizontal directional drilling system. The pipe handling device stores sections of drill pipe in individual columns within a magazine. The magazine is constructed so that it can be mounted to a boring machine in a pin-up or pin-down orientation. A plurality of signal elements are attached to the magazine and each extend at least partially within a footprint of each column. The signal elements may move from a first position, indicating the column is full of pipe sections, to a second position, indicating the column is not full of pipe sections. A proximity sensor assembly detects movement of the individual signal elements and signals a processor accordingly. These signals indicate whether or not a given column is full of pipe sections.

23 Claims, 22 Drawing Sheets

(56) References Cited

U.S. PATENT DOCUMENTS

| | | | | |
|---|---|---|---|---|
| 2002/0153169 | A1* | 10/2002 | Sewell | B65G 1/08 175/52 |
| 2003/0196791 | A1 | 10/2003 | Dunn et al. | |
| 2005/0103526 | A1 | 5/2005 | Ayling | |
| 2007/0240903 | A1 | 10/2007 | Alft et al. | |
| 2013/0240269 | A1* | 9/2013 | Novelo | E21B 19/20 175/85 |

* cited by examiner

PIPE STORAGE BOX

CROSS REFERENCE TO RELATED APPLICATION

This application is the continuation-in-part of PCT Patent Application No. PCT/US2015/051976, filed on Sep. 24, 2015, which claims the benefit of U.S. Provisional Patent Application Ser. No. 62/054,796, filed Sep. 24, 2014, the entire contents of which are incorporated herein by reference.

FIELD

This invention relates generally to the field of horizontal boring and in particular to machines used in horizontal boring.

SUMMARY OF THE INVENTION

The present invention is directed to a system comprising a magazine defining spaced and parallel first and second external faces and having structure forming at least one interior column that extends between the faces, and at least one movable signal element attached to the magazine adjacent its first face and extending at least partially within a footprint of one and only one interior column.

The present invention is also directed to a horizontal boring machine comprising a frame having a first end and a second end, a carriage supported on the frame and movable between the first end of the frame and the second end of the frame, and a first locating pin disposed proximate the second end of the frame. The horizontal boring machine further comprises a magazine within which a pipe section may be received and stored, the magazine comprising a first end plate and a second end plate, a first locating pin receiver supported on the first end plate and positioned to receive the first locating pin, and a second locating pin receiver supported on the second end plate and positioned to receive the second locating pin.

DESCRIPTION OF THE PREFERRED EMBODIMENTS

Figure 1:
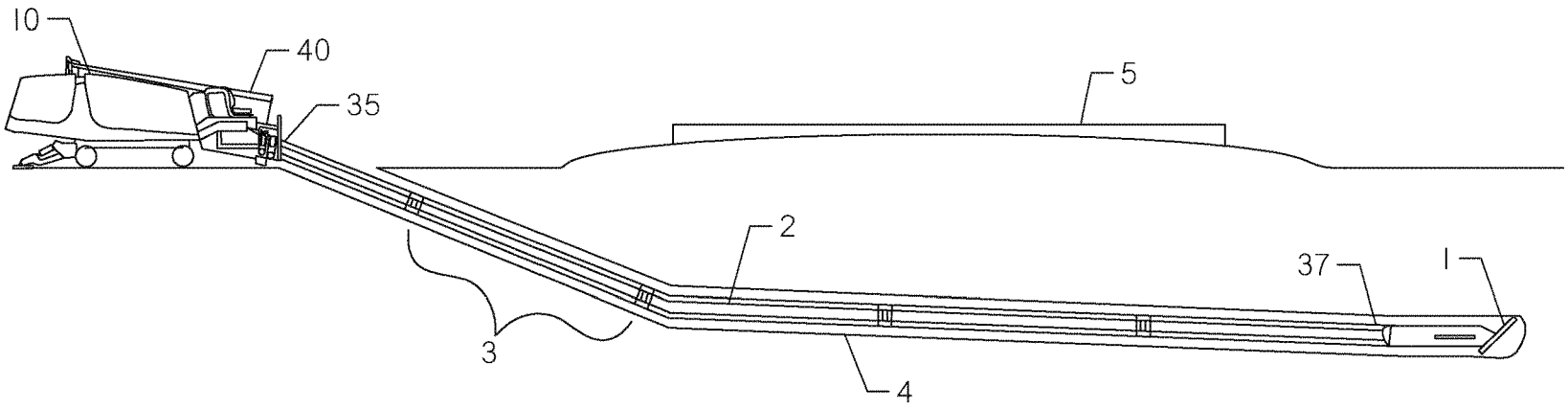
FIG. 1 is a representative illustration of a horizontal boring operation.

Turning now to the figures, and specifically to FIG. 1, a horizontal directional drilling operation is shown. Horizontal directional drilling ("HDD") or boring permits the installation of utility services or other underground products in an essentially "trenchless" manner, minimizing surface disruption along the length of the project and reducing the likelihood of damaging previously buried products or surface obstructions 5. The typical HDD borepath begins from the ground as an inclined segment that is gradually leveled off as the desired depth is neared by the drill bit 1. This depth is maintained, or a near horizontal path is followed, for the specified length of the product installation. As a drill string 2 is pushed into the ground behind the drill bit 1 new sections of pipe 3 are added to the uphole end of the drill string. The pipe section 3 may range from three (3) feet long to over ten (10) feet. Thus, as the boring operation progresses to drill a pilot bore 4 new sections of drill pipe must be added to the uphole end of the drill string 2. Likewise, when the drill string 2 is pulled from the ground, such as during backreaming, pipe sections 3 are removed from the drill string 2. The pipe sections 3 are typically stored for use in a magazine 40 that is supported on the boring machine 10 and moved between the magazine and a spindle 34 (FIG. 2) during the boring operation. The process of adding or removing pipe sections from the drill string may be labor intensive and time consuming. Quick make-up and breakout of pipe sections with the drill string is important to operators to maintain an efficient and profitable boring operation.

The present invention provides an improved HDD machine 10 having a magazine 40 that is easily connected to and removed from the boring machine yet secured in place when in use. The HDD machine 10 of the present invention also comprises an improved pipe handling system designed to speed-up the make-up and break-out of pipe sections 3 with the drill string 2 and movement of such pipe sections between the spindle 34 and the magazine 40.

Figure 2:
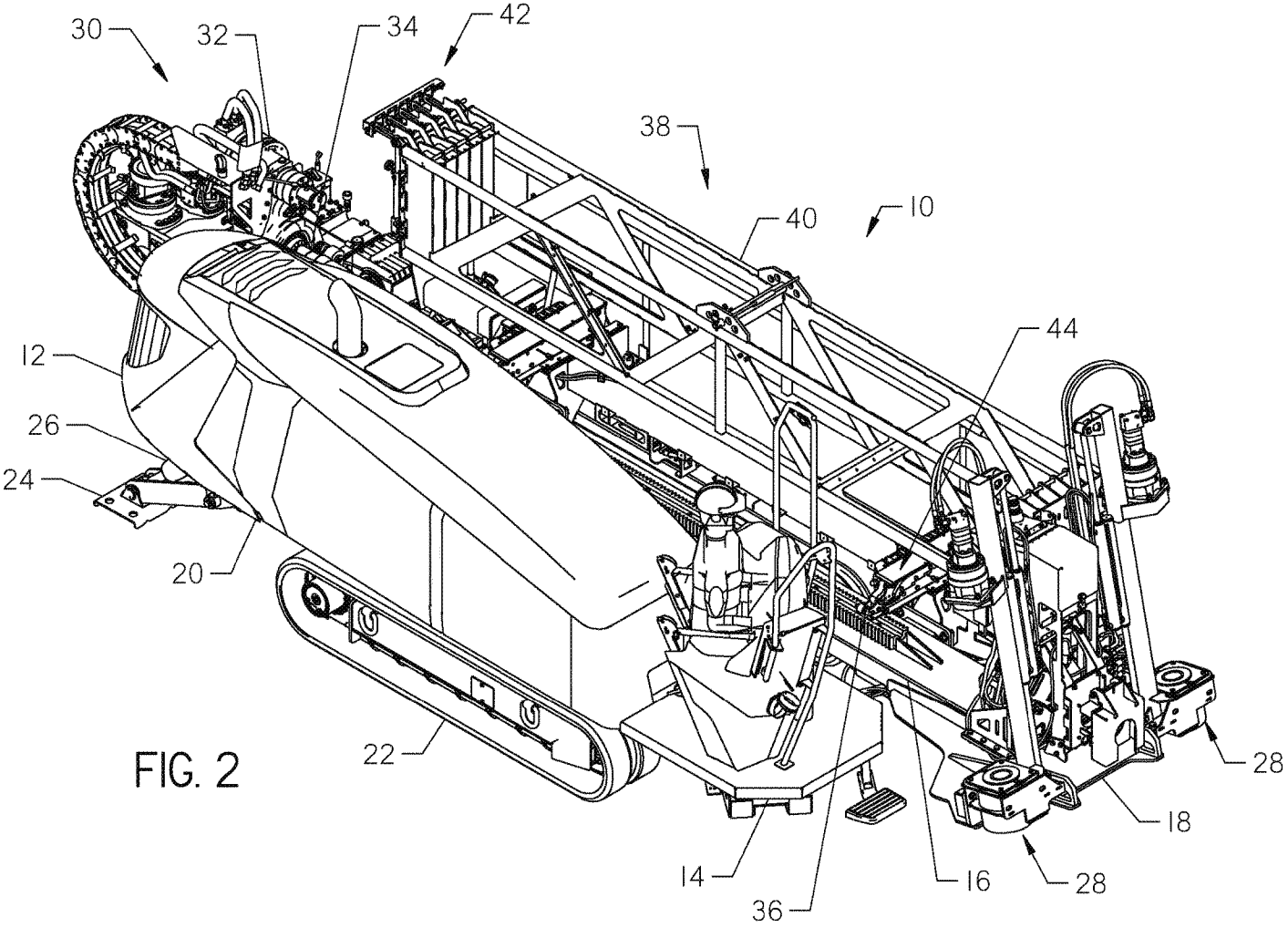
FIG. 2 is a perspective view of a horizontal boring machine of the present invention.

Turning now to FIG. 2, shown therein is the horizontal boring machine 10 constructed in accordance with the present invention. The machine 10 comprises an engine (not shown) housed within an engine cowl 12. The engine may comprise an internal combustion engine or an electric engine and hydraulic motors used to power the various functions of the machine. An operator station 14 may be disposed near the engine and comprises controls used by the operator to control the various functions of the machine. The engine and operator station 14 may be supported on a frame 16 having a first end 18 disposed at the front of the machine 10 and a second end 20 disposed at the rear of the machine. The frame 16 is supported on a pair of endless tracks 22 that are useful for moving the machine from location to location. A stabilizer 24 is positioned at the rear 20 of the machine 10 and may be actuated by a hydraulic cylinder 26. At the front 18 of the machine 10, a pair of earth screw assemblies 28 are attached to the frame 16 and used to anchor the machine to the ground during the horizontal boring operation.

A carriage 30 is supported on the frame 16 and is movable along the frame between the first end 18 and the second end 20. A rotary drive 32 is supported on the carriage 30 and transmits torque to the spindle 34 supported on the carriage for movement therewith. The spindle 34 is threadably connectable to a drill pipe section 3 (FIG. 1) at a first end 35 (FIG. 1) of a drill string 2. The spindle 34 transmits torque along the plurality of drill pipe sections 3 comprising the drill string 2 to the downhole tool 1 at a second end 37 of the drill string. The carriage 30 moves back and forth on the frame 16 along a rack 36 to push and pull the drill string 2 through the ground. A pinion (not shown) disposed on the underside of the carriage 30 engages the rack 36 and drives the carriage along the frame 16.

A pipe handling device 38 for storing and supplying pipe sections 3 (FIG. 1) for use with the machine 10 is shown supported on the frame 16. The device 38 comprises a magazine 40 within which a pipe section 3 may be received and stored and a pipe sensor 42. The pipe sensor 42 is disposed to detect the presence and absence of a pipe section 3 within the magazine 40. A pipe handling assembly 44 is disposed under the magazine 40 and transports a pipe section 3 on a delivery path between the magazine and the spindle 34.

Figure 3:
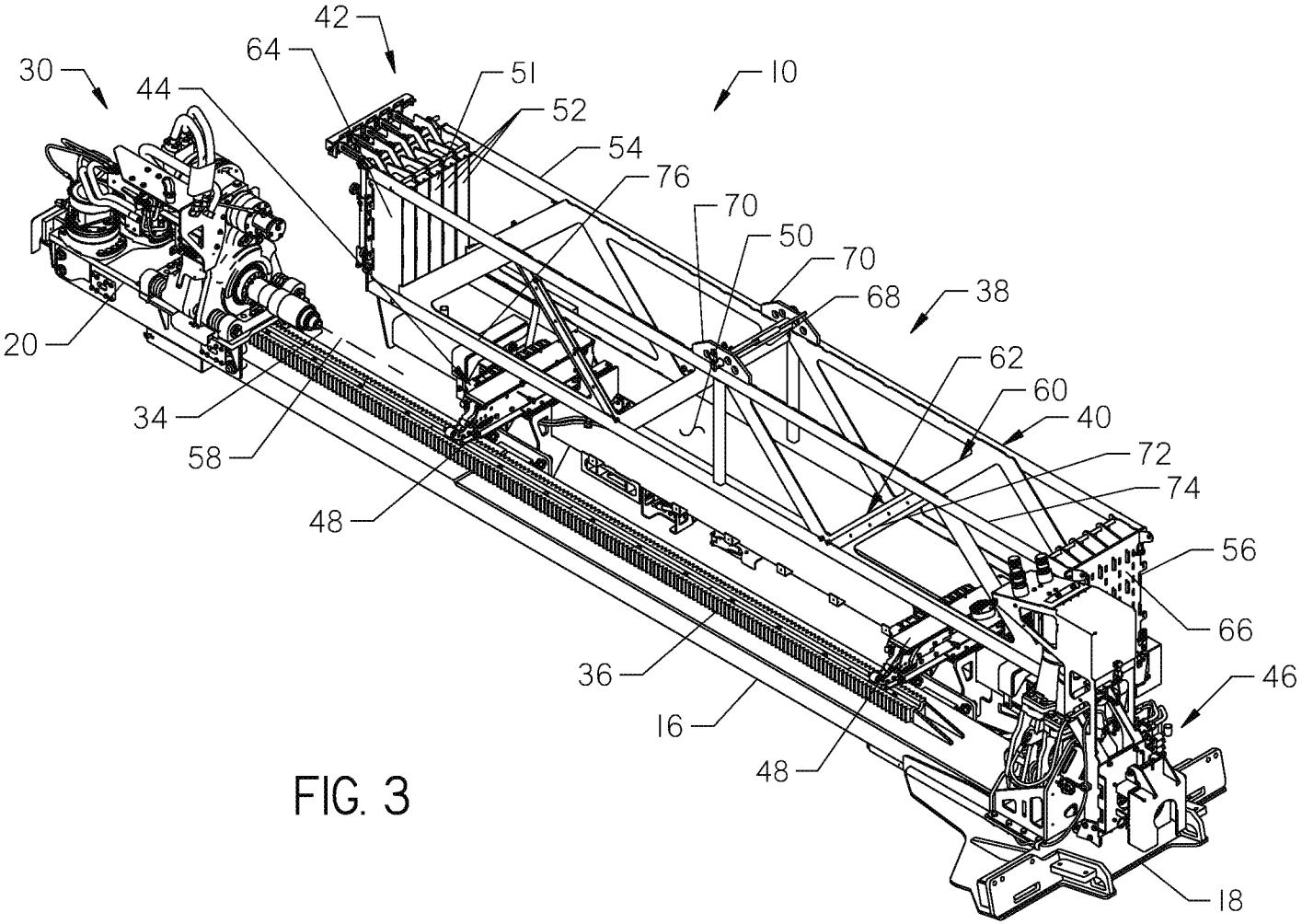
FIG. 3 is a perspective view of the horizontal boring machine of FIG. 2 with several components removed to more clearly show the pipe handling assembly of the invention.

Turning now to FIG. 3, the machine 10 is shown with several components such as the engine and operator station removed to more clearly show the frame 16, carriage 30, and pipe handling device 38. As shown in FIG. 3, the carriage 30 is disposed at the second end 20 of the frame 16. When in this position the spindle 34 is prepared to receive a pipe section 3 (FIG. 1) from the magazine 40. A make-up and breakout assembly 46 is disposed at the first end 18 of the frame 16. The make-up and break-out assembly 46 comprises wrenches 45 used to partially thread and unthread a pipe section from the drill sting 2. The rack 36 is disposed along the length of the frame 16 and provides a track for the carriage 30 to travel along as the pipe section 3 is pushed into the ground or pulled out of the ground.

The pipe handling assembly 44 comprises a pair of shuttle arms 48 that are used to transport the pipe section 3 between the magazine 40 and the spindle 34. The shuttle arms 48 receive the pipe section 3 through a lower portion of the magazine comprising a discharge outlet 50. The pipe section 3 may be stored in the magazine in a plurality of columns 51 within each of which a plurality of pipe sections may be received and stored. The columns 51 are defined by dividers 52 disposed at both a first end 54 and a second end 56 of the magazine 40. The pipe sensor 42 is disposed at the first end 54 of the magazine 40 near the top of the magazine. The pipe sensor 42 is able to detect the presence or absence of a pipe section within the magazine and the movement of a pipe section through the discharge outlet 50 to or from the spindle axis 58 of the machine 10. Specifically, the pipe sensor 42 monitors the removal of a pipe section 3 from a column 51 or the addition of a pipe section to a column.

The magazine 40 is generally rectangular and has an open bottom comprising the discharge outlet 50, two elongate side walls 60 and 62, a first end plate or 64, and a second end plate 66. The top of the magazine is generally open and may comprise a center cross bar 68 and lift points 70 for lifting the magazine to move it to and from the frame 16. The side walls 60 and 62 may be defined by a support brace 72 extending between a top rail 74 and bottom rail 76.

Figure 4:
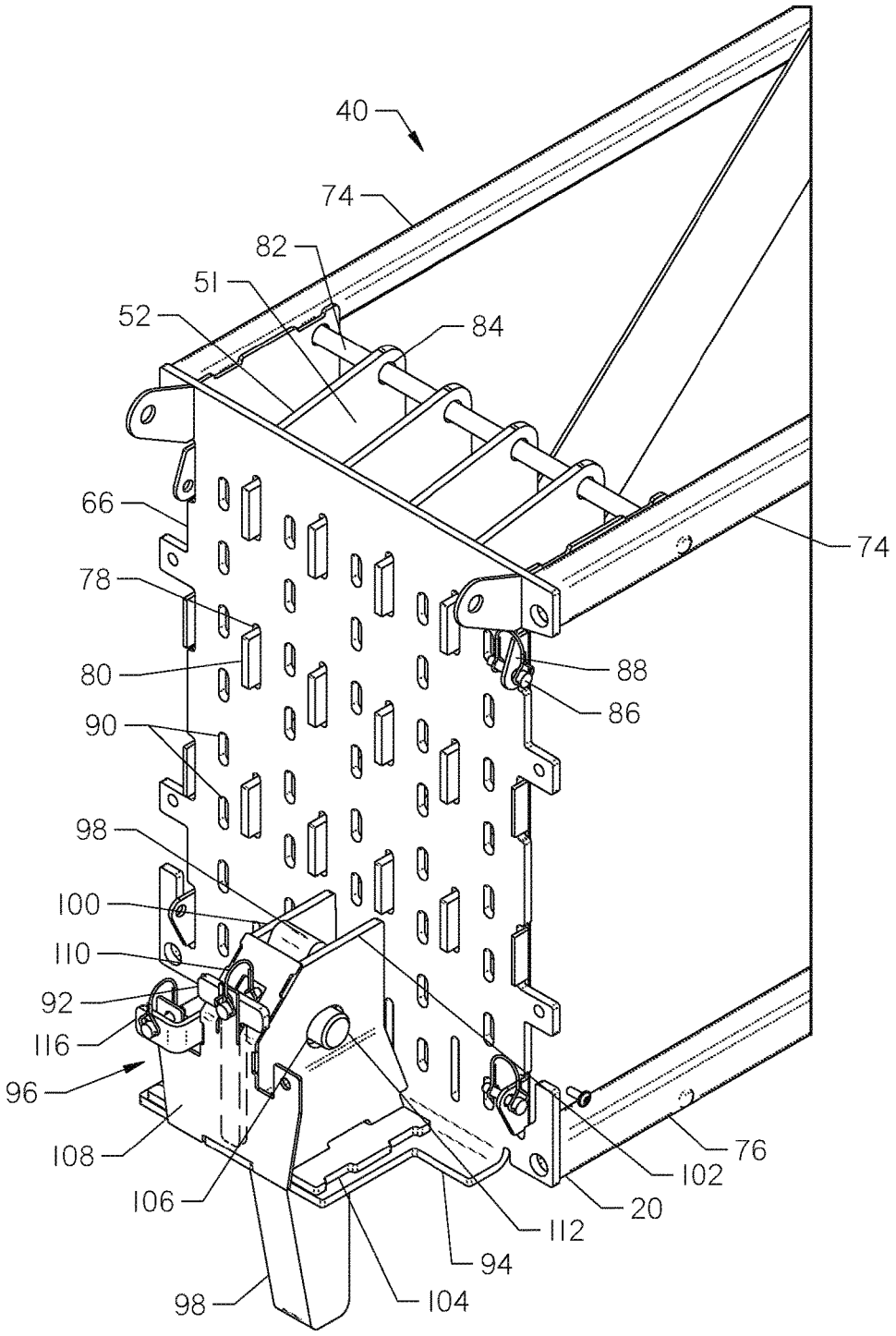
FIG. 4 is a view of an end of the magazine shown in FIGS. 2 and 3.

Turning now to FIG. 4, the second end 56 of the magazine 40 is shown in close up. While the second end 56 is shown in FIG. 4 and will be discussed in detail herein, the end of the magazine shown in FIG. 4 may be either the first end 54 or the second end 56 of the magazine 40 because both ends are identical. Having a magazine with identical ends such that there is no distinction between the ends except for the direction of the pipe held within the magazine permits the magazine to be supported on the frame for "pin-up" or "pin-down" threading by the spindle.

The top rails 74 are connected to a vertical second endplate 66. The end plate 66 comprises a plurality of slots 78. The slots 78 are configured to receive tabs 80 formed on the dividers 52 to help secure the dividers to the end plate 66. Dividers 52 are also supported on a crossbar 82 that spans the distance between the top rails 74 and passes through a hole 84 formed in each divider. Grenade pins 86 may be used with tabs 88 to further secure the end plate 66 and dividers 52 to the tops rails 74 and bottom rails 76.

The end plate 66 also comprises a plurality of pipe slots 90. The pipe slots 90 are arranged in columns and rows on the end plate 66 to correspond to the number of columns 51 and rows of pipe sections that may be stored within the magazine 40 when the magazine is full. The pipe slots 90 generally align with a fluid passage of a pipe section 3 stored within the magazine. A pin 92 having a generally T-shaped configuration may be inserted into the pipe slots 90 and the fluid passage of the pipe section on both ends of the magazine 40 to secure the pipe section within the magazine and prevent the pipe section from falling out through the discharge outlet of the magazine.

Continuing with reference to FIG. 4, the bottom of the end plate 66 bends outward to form a flange 94. The flange 94 may comprise a plate and supports a locating pin receiver 96 supported on the end plate 66. Of course, because the first end 54 and second end 56 of the magazine may be identical, another locating pin receiver may be supported by the first end plate 64. The pin receiver 96 is configured to receive a locating pin 98 disposed proximate the second end of the frame, while the first pin receiver at the first end 54 of the magazine (not shown) receives a locating pin 98 disposed proximate the first end of the frame 16. The pin receiver 96 comprises a pair of parallel vertical plates 100 and 102 supported on a base 104 that is secured to the end plate 64. The base 104 and flange 94 both comprise corresponding holes (not shown) configured to receive the locating pin 98 so that it aligns with holes 106 formed in the vertical plates 100 and 102. An end cap 108 provides support for vertical plates 100 and 102 and also may be configured to support T-shaped pin 92 with a grenade pin 110 when the pin is not in use.

A locking pin 112 passes through the holes 106 formed in the vertical plates 100 and 102 and a hole 114 (FIG. 5) formed in the locating pin 98. The locking pin 112 comprises an arm 116 that may be pinned to the end plate 108 to secure the locking pin 112 to the pin receiver 96. The magazine 40 is securely supported on the frame 16 when the locating pins 98 are disposed within the locating pin receivers 96 and secured therein by the locking pins 112.

Figure 5:
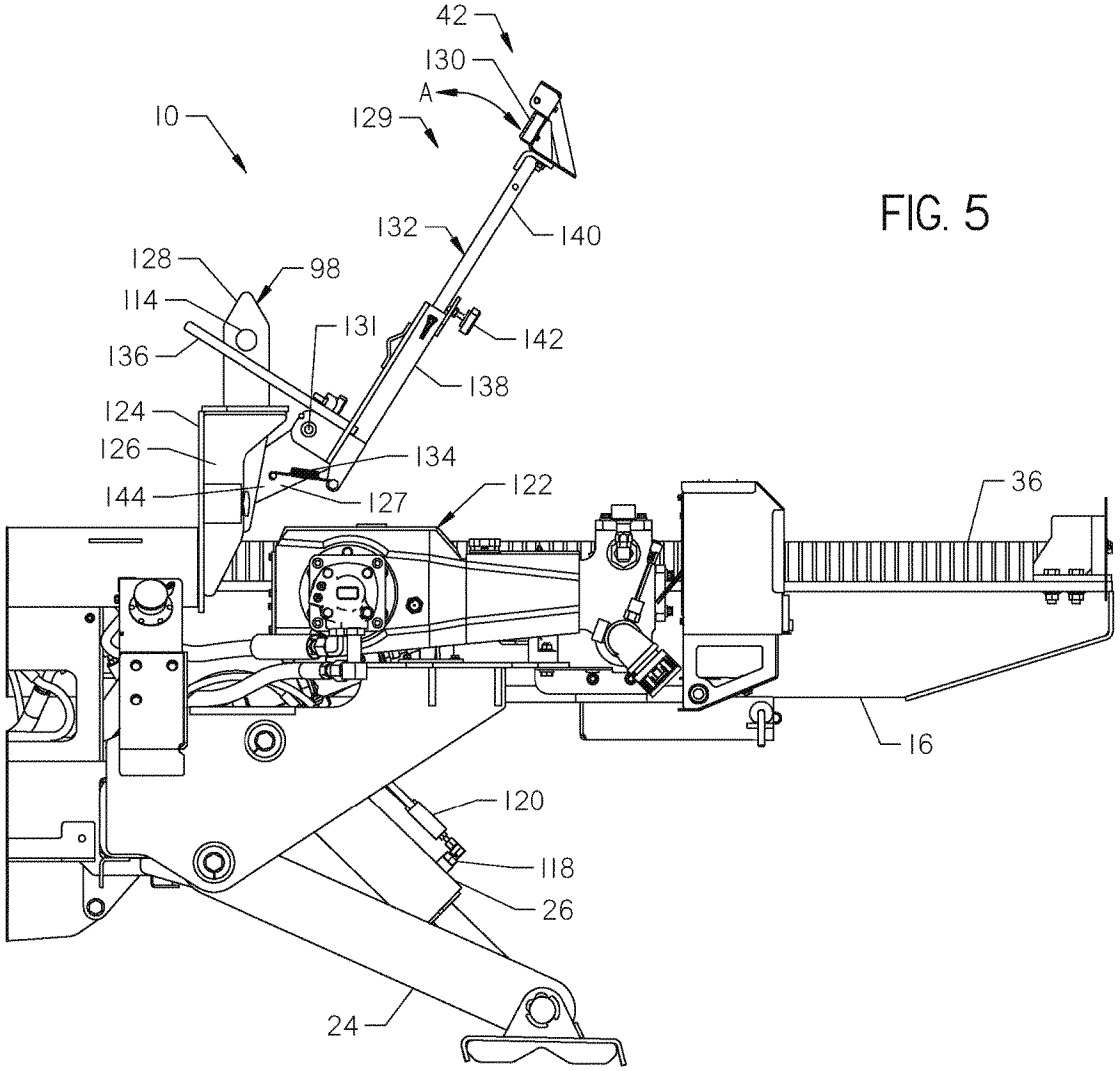
FIG. 5 is a partial end view of the horizontal boring machine of FIG. 2.

Turning now to FIG. 5, a partial side view of the back end of the machine 10 is shown with the magazine 40 removed from the machine. The rack 36 of the rack and pinion carriage drive is shown supported on the frame 16 along with stabilizer 24. Fluid cylinder 26, used to actuate stabilizer 24, is shown connected to the frame 16 at one end and the stabilizer at the other end of the cylinder. The cylinder 26 receives fluid and/or releases fluid through inlet 118 and hose 120 to drive operation of the cylinder. A mud pump motor 122 is shown supported on the frame 16 and is used to pump drilling fluid downhole through the fluid passage of the drill string 2 to the drill bit 1 or backreaming tool.

With the magazine removed from the machine 10 the locating pin 98 is more clearly visible because the locating pin receiver 96 is not blocking the view of the pin. The pin 98 is supported on the frame 16 by an L-shaped bracket 124. The L-shaped bracket 124 may comprise a pair of supports 126 disposed on either side of the pin 98.

Both locating pins 98 comprise a base 127 and a tapered top portion 128 configured to guide the locating pins into the pin receiver 96. A hole 114 may be formed in the top portion 128 of each of the locating pins 98 to receive lock pin 112 (FIG. 4) within the hole and corresponding holes 106 formed in the locating pin receivers 96 to secure the magazine 40 to the frame 16. The base portion 127 of the locating pin 98 passes through a hole (not shown) in the shorter leg of the L-shaped bracket 124 and may be secured to the bracket and supports 126 by welding or other methods of fastening the pin 98 to the frame 16.

Continuing with FIG. 5, a proximity sensor assembly 129 is shown supported on the frame 16. The proximity sensor assembly 129 comprises a pipe sensor 42 to detect the presence or absence of a pipe section 3 within the magazine. The pipe sensor 42 may comprise sensor array 130. Sensor array 130 may comprise a plurality of proximity sensors 170 (FIG. 8) each disposed to detect the presence or absence of a pipe section 3 within a column 51 of the magazine 40. The proximity sensor assembly 129 is pivotally connected to the frame 16 at pivot point 131 and comprises a post 132, a biasing member 134, and an arm 136. Post 132 is used to support the plurality of proximity sensors 170. The post 132 comprises a bottom member 138 and a top member 140. The top member 140 may telescope from within the bottom member 138 to allow adjustment of the height of the proximity sensor assembly 129 to the height of the magazine supported on the frame. When the desired height is reached, locking member 142 may be engaged to lock the top member 140 relative the bottom member 138.

The biasing member 134 comprises a spring connected at one end to the bottom of the post 132 and a support member 144 at the other end to bias the plurality of proximity sensors 170 supported on the post away from the magazine. The arm 136 is connected to the post 132 and disposed for engagement with the bottom of the magazine 40 as the magazine is lowered onto the frame 16 and guided into position by the locating pins 98. The weight of the magazine is able to overcome the biasing force of the spring 134 and the proximity sensor assembly 129 pivots about pivot point 131 to move the plurality of proximity sensors 170 in direction A to a position proximate the magazine.

Figure 7:
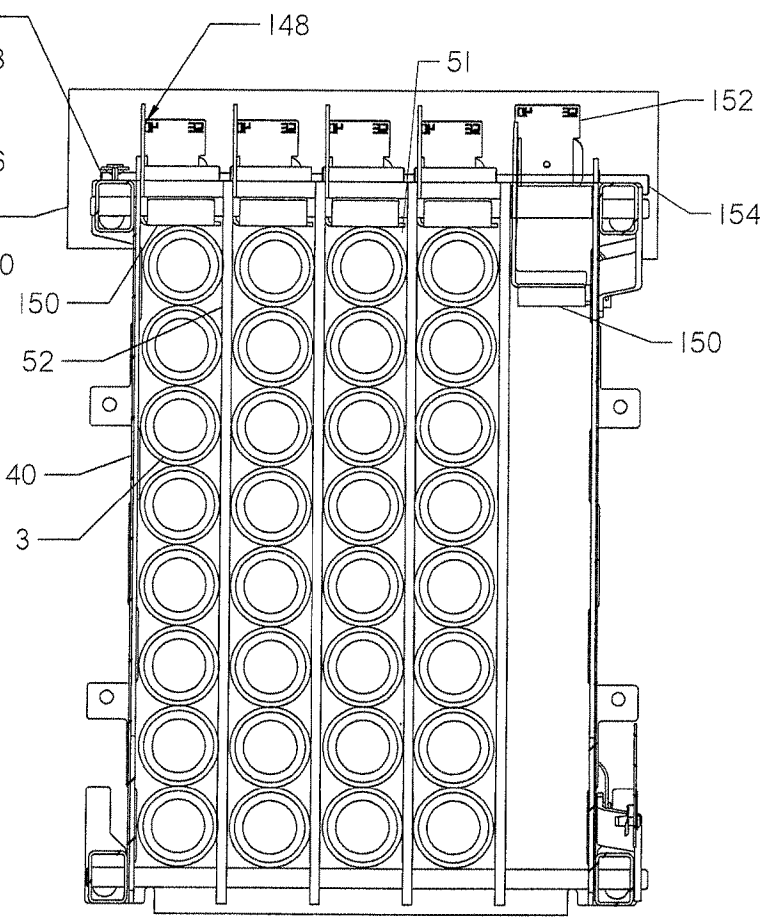
FIG. 7 is a cross-section view of the magazine having one column empty.
Figure 6:
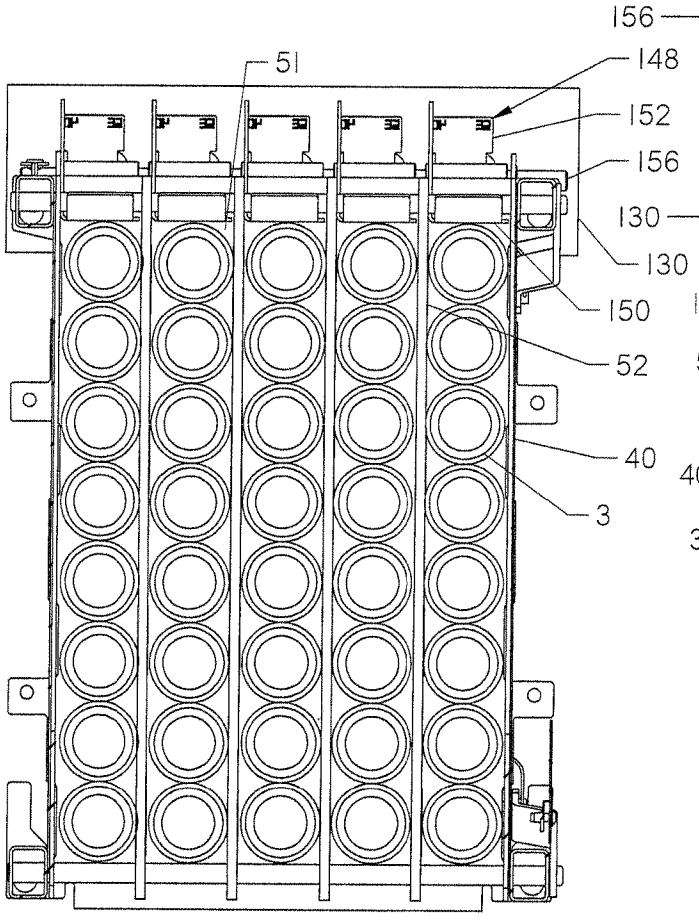
FIG. 6 is a cross-section view of the magazine filled with pipe sections.

Turning now to FIGS. 6 and 7, the magazine 40 is shown in cross-section having a plurality of drill pipe sections 3 disposed in columns 51 defined by dividers 52. The view shown in FIGS. 6 and 7 is looking from the front 18 of the machine near the earth screw assemblies 28 (FIG. 1) toward the rear 20 of the machine. The sensor array 130 is shown disposed at the top of, and behind the magazine 40. The sensor array 130 may comprise a plurality of pipe sensors comprising proximity sensors 170 (FIG. 8), each proximity sensor corresponding to an individual column. A plurality of pipe indicators 148, are disposed proximate a single proximity sensor to communicate the presence and absence of pipe sections 3 within a column 51. For example, when an individual column is full the pipe level indicator 148 is in the position shown in FIG. 6. However, when a pipe section 3 has been removed from a column, or as shown in FIG. 7 when a column is empty, the pipe level indicator 148 will move to the position shown in FIG. 7. Each of the plurality of pipe indicators 148 may comprise a pipe engaging member 150 and a flag 152 detectable by the proximity sensor. A pivot point 154 is disposed between the pipe engaging member 150 and the flag 152. Each pipe indicator 148 is supported on a pivot bar 156 about which the pipe indicator is allowed to rock about the pivot point 154. Thus, the pipe engaging member 150 moves down when a pipe section 3 is removed from the bottom of the column and flag 152 is raised upward and away from the proximity sensor 130.

Figure 8:
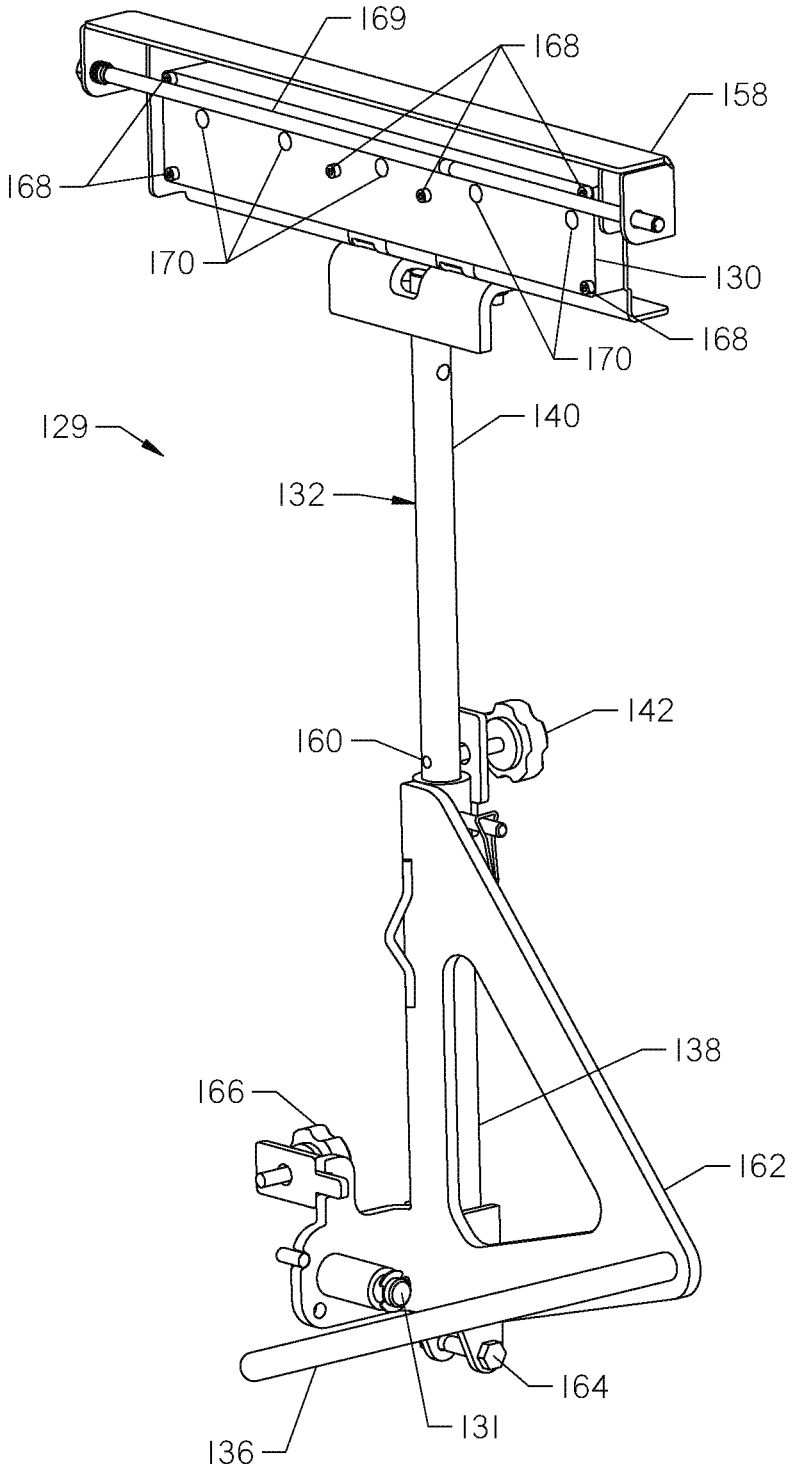
FIG. 8 shows a proximity sensor assembly.

With reference now to FIG. 8, the proximity sensor assembly 129 of FIG. 5 is shown in more detail. A sensor housing 158 is shown supported at the top of post 132. Post 132 comprises the top member 140 and bottom member 138. Locking member 142 is configured to engage predrilled holes 160 in the top member 140 to lock the height of the post 132 relative to the magazine 40 (FIG. 1). The bottom member 138 is supported on a generally triangular bracket member 162. The arm 136 extends from an apex of the bracket 162 to position the arm for engagement with the magazine 40 when the magazine is supported on the frame. Pivot 131 and biasing member connection point 164 are also shown in FIG. 7. An assembly lock 166 may be supported on the bracket 162 and used to secure the assembly 129 to the magazine 40 to decrease movement of the assembly during operation of the machine 10 (FIG. 1).

The housing 158 supports the sensor array 130. The sensor array 130 may be connected to the housing with a plurality of fasteners 168. Fasteners 168 may comprise bolts that allow easy removal of the senor array 130 for replacement or service. Additionally, a retention bar 169 may be positioned to help secure and align the sensor array 130 within the housing 158. The sensor array 130 may comprise a plurality of pipe sensors 170 comprising proximity sensors positioned to detect the presence or absence of a pipe section 3 within a respective column 51 by detecting the presence or absence of the flag 152 as discussed with reference to FIGS. 6 and 7. When the flag 152 is in the position shown in FIG. 6 the sensor 170 detects the presence of the flag 152 in front of the sensor. When a pipe section is removed from a column the proximity sensor 170 cannot detect the flag 152 as it has pivoted upward (as shown in FIG. 7). The sensor 130 sends a signal to a processor at the operator station indicating a pipe section has been removed from the column. The processor uses this data to determine which column the pipe handling assembly should remove pipe sections from or which column to place pipe sections into. Likewise, when the column is full the proximity sensor 170 detects the presence of the flag 152 and sends a signal to the processor indicating the column is full. The processor uses this data from the sensor to fill a column that is not yet full when pipe sections are being added to the magazine.

Figure 9:
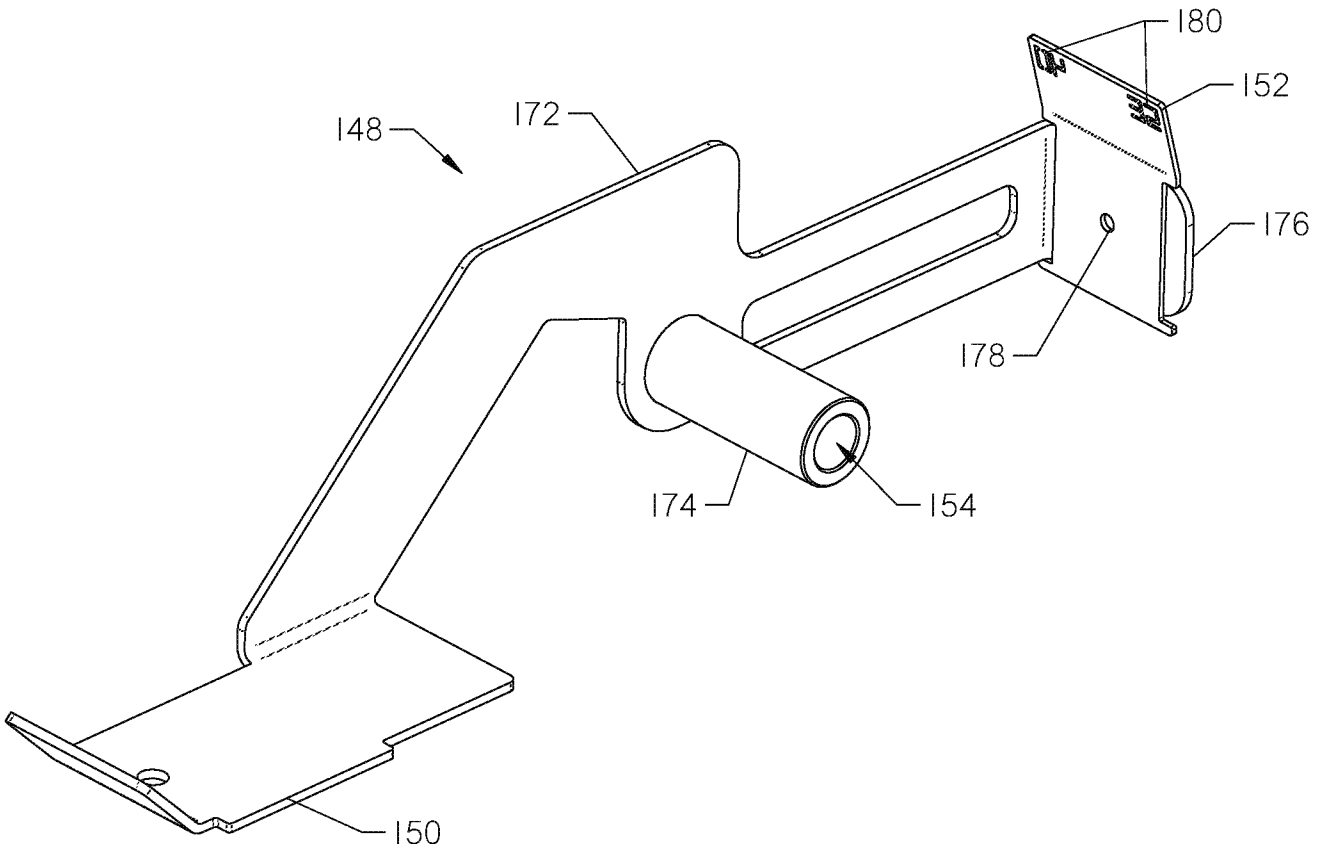
FIG. 9 shows a representative pipe indicator of FIGS. 6 and 7 of the present invention.

Turning now to FIG. 9, a representative pipe indicator 148 of FIGS. 6 and 7 is shown in greater detail. The pipe indicator comprises a body 172, a pipe engaging member 150 at a first end of the body, and a flag 152 disposed at a second end of the body. As shown, the body 172 and pipe engaging member 150 may be constructed from a single piece of metal. However, one skilled in the art will appreciate that the pipe indicator 148 may be constructed from component pieces attachable and detachable from the body 172 to permit the use of pipe engaging members 150 and flags 152 of different sizes and configurations. While the flag 152 is shown in a substantially vertical orientation, one skilled in the art will appreciate the flag 152 may be disposed in a horizontal or other orientation to make contact with the proximity sensor 170. Likewise, pipe engaging member 150, shown in a generally horizontal orientation, may be oriented in a variety of configurations to engage pipe sections stored within the magazine.

The pivot point 154 is disposed between the flag 152 and the pipe engaging member 150. The pivot point is defined by a cylindrical housing 174 that is configured to receive pivot bar 156 (FIGS. 6 and 7). A bearing (not shown) may be disposed within housing 174 to assist in the pivotal movement of the pipe indicator relative to the pivot bar 156. The housing 174 is positioned on the body 172 so that the pipe engaging member is supported on pivot bar 156 to bias the pipe engaging member 150 to pivot downward and the flag 152 upward when a pipe section has been removed from the selected column. Thus, if the body is divided by the pivot point 154, there is a greater amount of weight on the pipe engaging member 150 side of the pivot point than on the flag 152 side of the pivot point. Weighting the pipe indicators in this manner causes the default position of the flag 152 to be upright so that the flags do not contact the proximity sensor 170 when the column 51 is not full. This causes a "not full" signal to be transmitted to the operator or the processor used to control the pipe handling assembly.

Continuing with FIG. 9, the flag 152 is supported on a flag support 176 portion of the body 172 and may be secured to the support with a fastener disposed in a hole 178. Numbers 180 on flag 152 may be used to indicate the type or size of pipe stored within magazine 40. For example, the number "32" shown on flag 152 may be used to indicate the presence of ten (10) foot pipe in the magazine. When the operator desires to use pipe of a different length or size the flag may be turned around on support 176 so that the number "40" is correctly read to indicate the use of pipe section of a different length.

Figure 10:
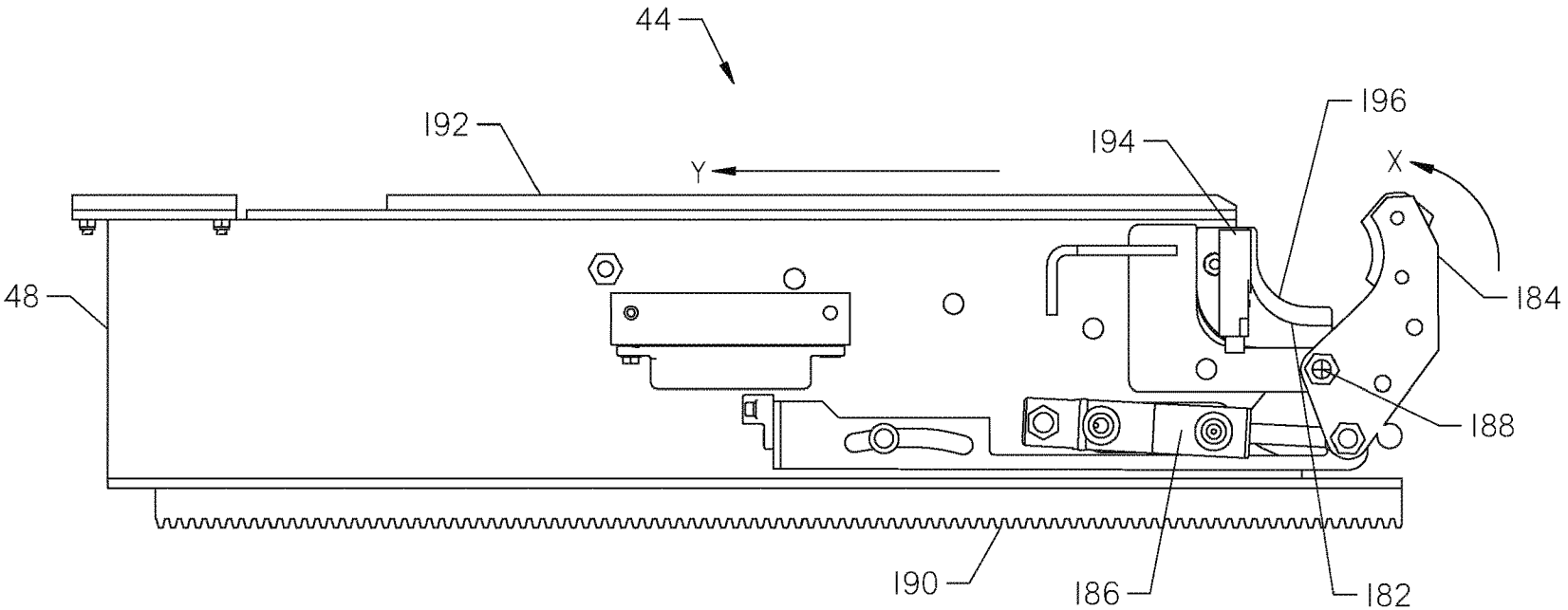
FIG. 10 shows a shuttle arm of the pipe handling assembly shown in FIG. 3.

With reference now to FIGS. 3 and 10, the pipe handling assembly 44 is discussed in more detail. The pipe handling assembly 44 is situated directly beneath the discharge outlet 50 of the magazine 40. The pipe handling assembly 44 comprises a pair of shuttle arms 48 movably supported on the frame 16, and a drive assembly (not shown) for driving the movement of the arms 48.

In FIG. 10 one of the two shuttle arms 48 is shown. The arms 48 comprise a pipe holding member 182 formed in the end of the arm proximal the horizontal boring machine 10. The pipe holding member 182 is adapted to receive and support the pipe section 3. The pipe holding member 182 may further comprise a retaining structure 184 for retaining the pipe section 3 in the pipe holding member. In a preferred embodiment, each retaining structure 184 is actuated by a cylinder 186 operatively connected to the arm 48 at one end and the retainer structure at the other end. The cylinder moves the retaining structure 184 about pivot point 188. Retaining structure 184 retains the pipe section 3 in pipe holding member 182 until the pipe section 3 is aligned with the spindle axis 58.

The arms 48 are positioned on the frame 16 generally parallel with each other. The arms are advanced and retracted laterally and generally perpendicular to spindle axis 58 of the horizontal boring machine 10 in such a manner as to shuttle pipe sections 3 between the horizontal boring machine and the magazine 40. The extension and retraction of the arms 48 is powered by a drive assembly supported on the frame.

The drive assembly may comprise a rack 190 and pinion gear (not shown) mounted on the frame 16. The rack 190 is operatively connected to each arm 48 and mates with a corresponding pinion gear. The rack and pinion gears are mounted in parallel on the frame 16.

Operation of a hydraulic motor causes the pinion gears to rotate. The rotating pinion gears engage the gears on racks 190. When the pinion gears rotate in a first direction, the arms 48 extend laterally in the direction of the horizontal boring machine IA thereby transporting a pipe section 3 to the spindle axis 58. The pinion gears may be rotated in a second direction to cause the pipe holding member 182 to retract away from the horizontal boring machine, thereby enabling return of a pipe section 3 to the magazine 40.

To receive a pipe section 3 from the magazine 40, the arms 48 of the pipe handling assembly 44 are retracted to position the pipe holding member 182 beneath the selected column 51 from which a pipe is to be received. Generally, pipe sections 3 are first retrieved from the column 51 proximal the horizontal boring machine 10 until this column is empty. Thereafter, pipe sections 3 will be retrieved from the immediately adjacent column 51 until it also is empty. Retrieval of pipe sections 3 will proceed in the same fashion until all columns 51 are empty or until the boring operation is completed.

After selecting the desired column 51, the arms 48 are retracted to position the pipe holding member 182 beneath the selected column. As the blocking member 192 of arms 48 recedes from beneath the selected column 51, the pipe section 3 positioned at the discharge outlet 50 of the selected column 51 falls into the pipe holding member 182. The retaining structure 184 is moved in direction X by actuation of the cylinder 186 to grip the pipe section 3 and prevent the pipe section from rolling off of the pipe holding member 182. A proximity switch 194 may be positioned proximate the pipe holding member 182 to detect the presence and/or absence of a pipe section within the holding member. Wear pads 196 may be disposed on the pipe holding member 182 and the retaining structure 184 to protect the holding member and retaining structure.

The arms 48 are then advanced to the spindle axis 58 for connection of the pipe section 3 in the pipe holding member 182 with the drill string of the horizontal boring machine 10. The horizontal boring machine 10 is operated to connect pipe section 3 to the drill string.

To receive a pipe section 3 from the horizontal boring machine 10 the arms 48 are advanced toward the spindle axis 58. As the arms 48 advance, the cylinder 186 retracts to open the pipe retainer 184. The pipe holding member 182 is aligned with the pipe section 3 to be received. After alignment with the pipe section 3, the cylinder 186 extends to move the retaining structure in direction X to the support position and retains the pipe section 3 in the pipe holding member 182 during transport back to the magazine. The pipe section 3 is unthreaded from the drill string and is supported solely by the pipe holding member 182. The arms 48 are then retracted in direction Y for return of the pipe section 3 to the magazine 40. Pipe sections 3 are replaced in the magazine 40.

The present invention includes a method for handling a plurality of pipe sections 3 at a horizontal boring machine 10. In the method a plurality of pipe sections 3 are stored in plural columns 51 of a multiple-column magazine 40. A single pipe section 3 is discharged from a first selected magazine column and transported to the spindle 34. Removal of a pipe section from the first selected column is visually indicated. In one embodiment, visual indication is accomplished by raising flag 152. The pipe section 3 is transported to the spindle 34 by the pipe handling assembly and added to the drill string 2 of the horizontal boring machine. The steps of removing a pipe section 3 from the magazine may be repeated until all pipe sections have been emptied from the first selected column. Removal of all pipe sections 3 from the first selected column may be visually indicated to the operator. Visual indication may be accomplished by further raising the flag 152 or by illumination of an indicator at the operator station. The steps of emptying a column may be repeated for one or more additional columns and may be repeated until all of the columns of the magazine have been emptied.

During a backreaming operation or when the drill string is simply pulled back through the borehole, a pipe section 3 may be removed from the drill string 2 of the horizontal boring machine and transported from the spindle 34 to a last emptied magazine column by the pipe handling assembly 44. The pipe handling assembly 44 uses arms 48 to transport the pipe section 3 along a delivery path between the spindle axis 58 and the discharge outlet 50 of the magazine. The pipe handling assembly 44 is also configured to lift the pipe section 3 into the column. As the drill string 2 is withdrawn from the borehole 4 and pipe sections 3 are removed from the drill string, the pipe handling assembly 44 transports the pipe sections to the magazine and places the pipe sections in a selected column until all pipe sections have been replaced in the selected column. The pipe indicators 148 are connected to the proximity sensors to indicate the presence or absence of pipe sections within each respective column. When the selected column is full again the pipe engaging member 150 of the pipe indicator 148 will be pushed up causing the flag 152 to pivot downward in front of the proximity sensor 170. The proximity sensor 170 will generate a signal that is communicated to the processor. Operation of the pipe handling assembly 48 is managed by the processor. In operation, data from the proximity sensors 170 is processed and used to determine which column to remove pipe sections from or which column to place pipe sections into.

With reference now to FIGS. 11-26, an alternative embodiment of the proximity sensor assembly 200 and corresponding pipe indicators or signal elements 202 are shown. An overview of the alternative embodiment of the proximity sensor assembly 200 and signal elements 202 is shown in FIG. 26. The proximity sensor 200 is best shown with reference to FIGS. 18-20. The signal elements 202 are best shown with reference to FIGS. 11-17.

Figure 11:
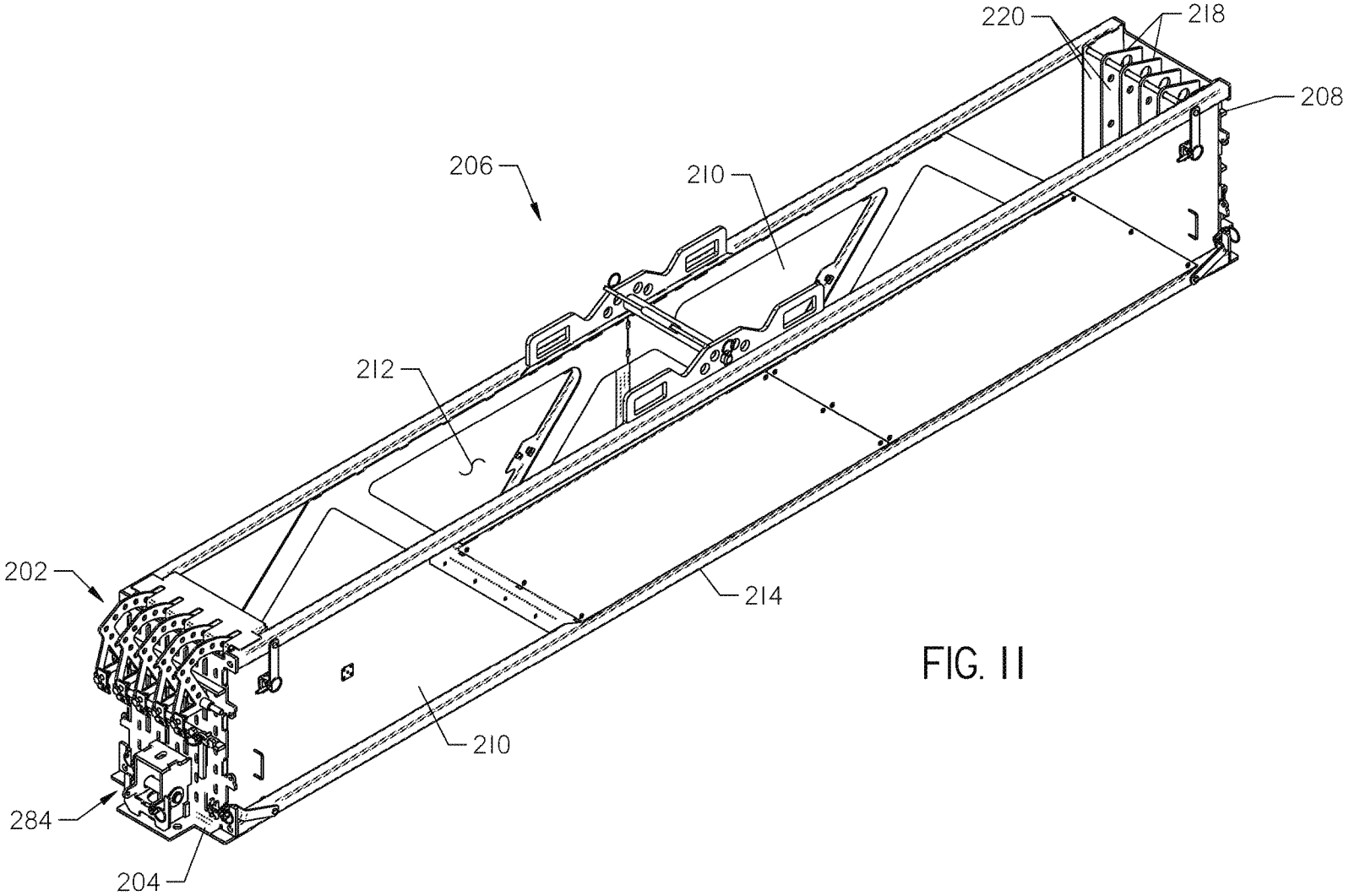
FIG. 11 is a perspective view of an alternative embodiment of the pipe indicators attached to the end of a magazine.

Starting with FIG. 11, the signal elements 202 are attached to a first end 204 of a magazine 206. Alternatively, the signal elements 202 may be attached to an opposed second end 208 of the magazine 206. The magazine 206 is identical to the magazine 40 described with reference to FIGS. 1-10, except that the alternative signal elements 202 and proximity sensor assembly 200 are used with the magazine 206. The magazine 206 also has an alternative embodiment of a locating pin receiver 284 attached to each end 204 and 208.

Figure 17:
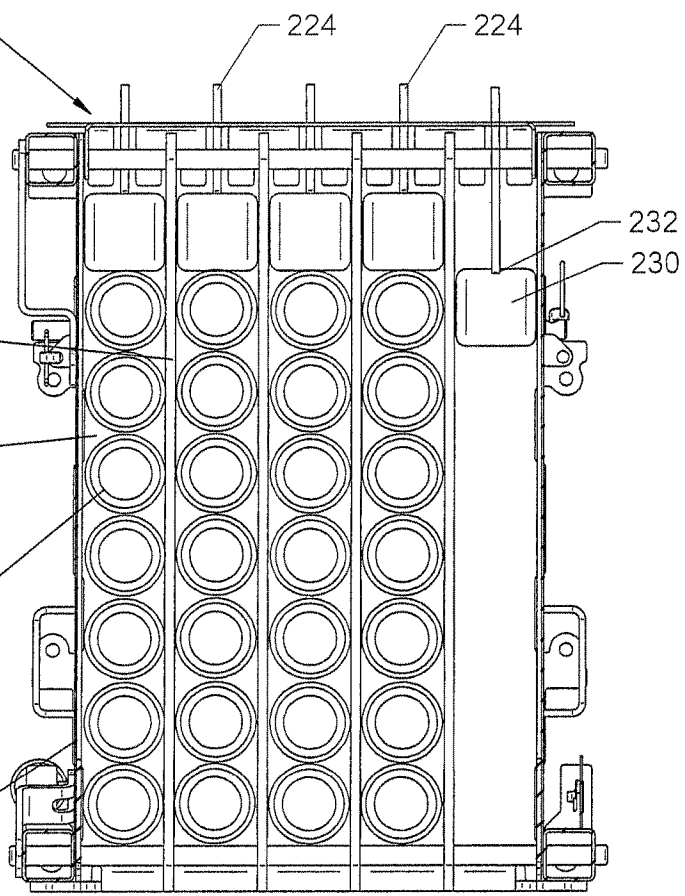
FIG. 17 is the view of FIG. 16, but having one column empty.
Figure 16:
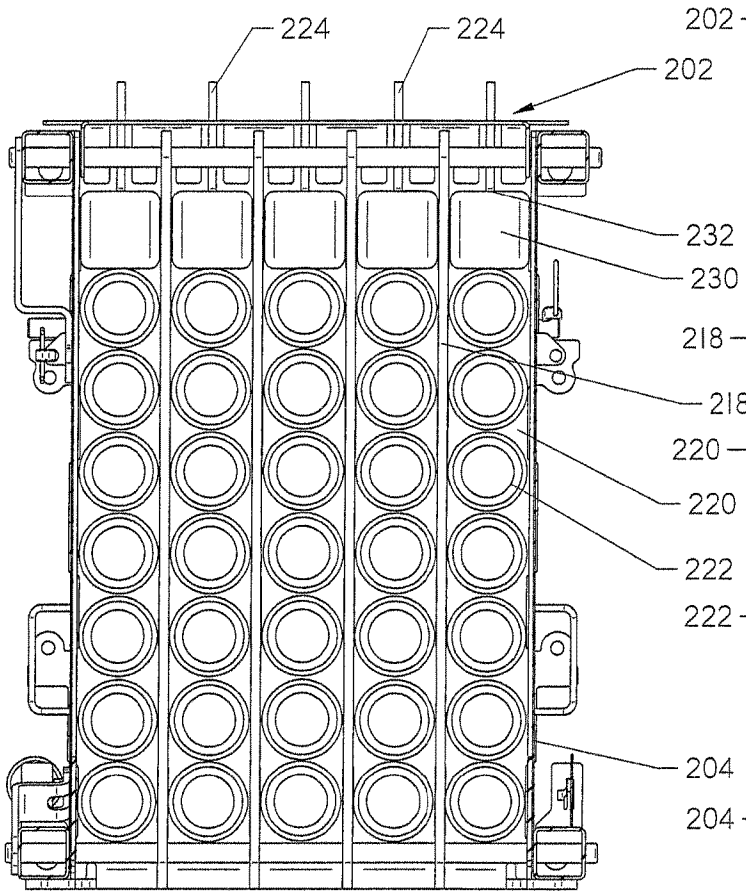
FIG. 16 is a cross-section view of the magazine of FIG. 11 filled with pipe sections.

The magazine 206, shown in FIG. 11, has sidewalk 210 formed between a first external face 212 and a second external face 214, such that the magazine forms the shape of a right rectangular prism. The signal elements 202 are attached to the magazine 206 adjacent its first external face 212. A plurality of dividers 218 are formed inside of the magazine 206 adjacent both its first end 204 and its second end 208. The dividers 218 create a plurality of rectilinear columns 220 within the magazine 206 that extend between the first external face 212 and the second external face 214. The columns 220 are each capable of holding a plurality of pipe sections 222 stacked on top of each other, as shown in FIGS. 16-17. The second external face 214 may be open and serve as a discharge conduit 216 for the pipe sections 222 held within the magazine 206. The dividers 218, columns 220, and pipe sections 222 are similar to those described with reference to FIGS. 1-10.

Referring now to FIGS. 12-17, the signal elements 202 are shown in more detail. The signal elements 202 each comprise a frame 224 having a partially arcuate portion. A target element 226 is attached to a first end 228 of the frame 224 and a first ballast element 230 is attached to its opposite second end 232. The arcuate portion of the frame 224 is situated immediately adjacent the first ballast element 230. A series of holes 234 are formed along the frame 224. The holes 234 decrease the weight of the frame 224.

The first ballast element 230 is heavier than the target element 226, because the first ballast element comprises a weight. The weight may be cylindrical in shape and have a cut-out 252 (FIGS. 13-14) formed on its outer surface along its horizontal axis. The cut-out is configured to receive a magnet 254. The magnet 254 helps the first ballast element 230 engage with the pipe sections 22 within the magazine 206. Additional ballast elements 230 may be attached to the second end 232 of the signal element 202 if needed to increase its weight or stability.

The target elements 226 comprise a plate 256 that is attached orthogonally to the first end 228 of the planar frame 224. The plate 256 is preferably rectangular in shape. The plate 256 has a top bolt hole 258 and a bottom bolt hole 260. The bolt holes 258 and 260 may hold a bolt 262. The target elements 226 serve as a target for the proximity sensor assembly 200 to detect during operation.

Figures 13, 14:
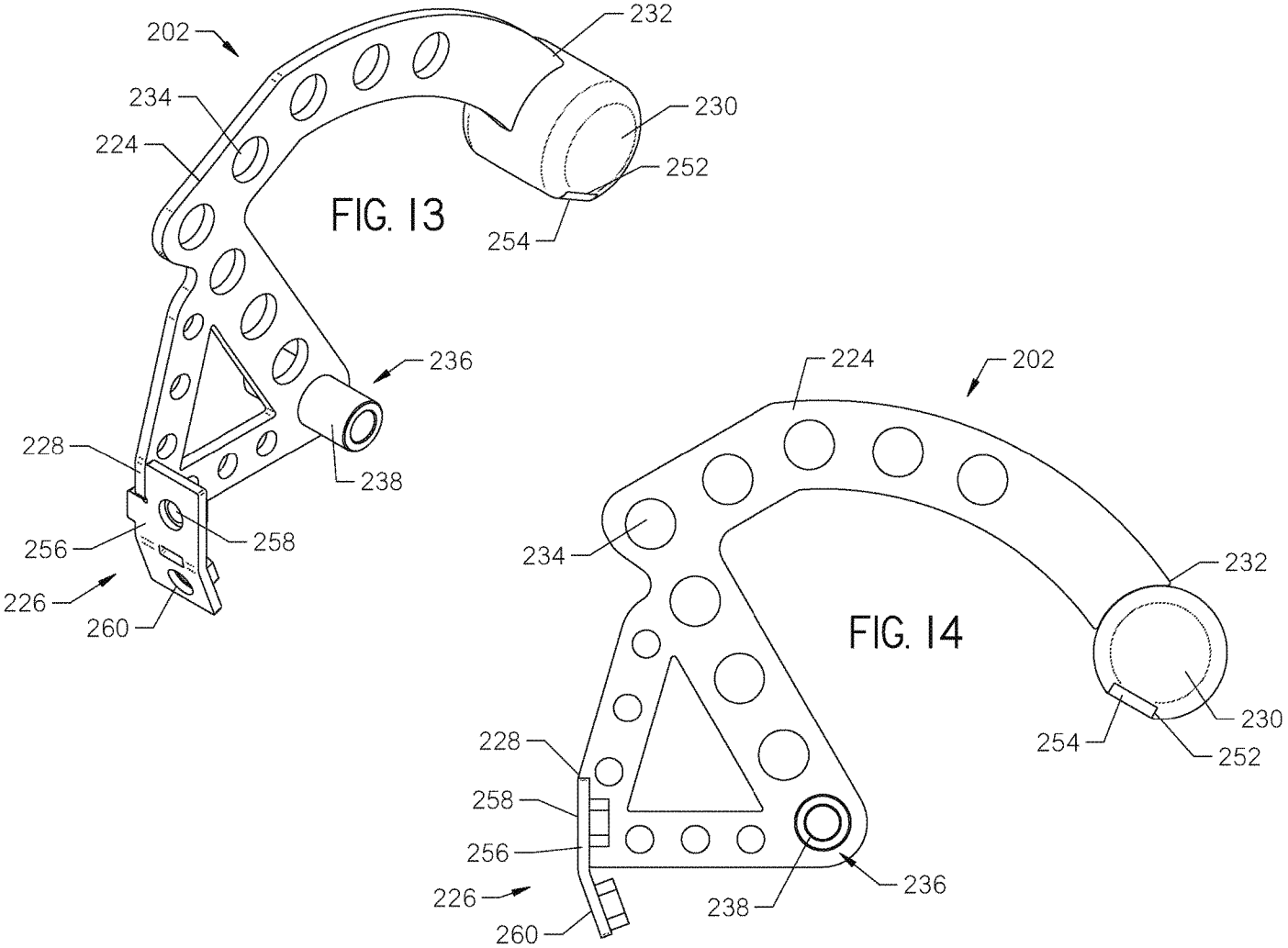
FIG. 13 is a perspective view of one of the pipe indicators shown in FIG. 11.
FIG. 14 is a side view of FIG. 13.

A pivot point 236 is formed between the target element 226 and the first ballast element 230. The pivot point 236 is in-line with the target element 226, as shown in FIGS. 13-14. The pivot point 236 is defined by a cylindrical housing 238 that is configured to receive a pivot bar 240. The signal elements 202 are attached to the first end 204 of the magazine 206 via the pivot bar 240.

Figure 12:
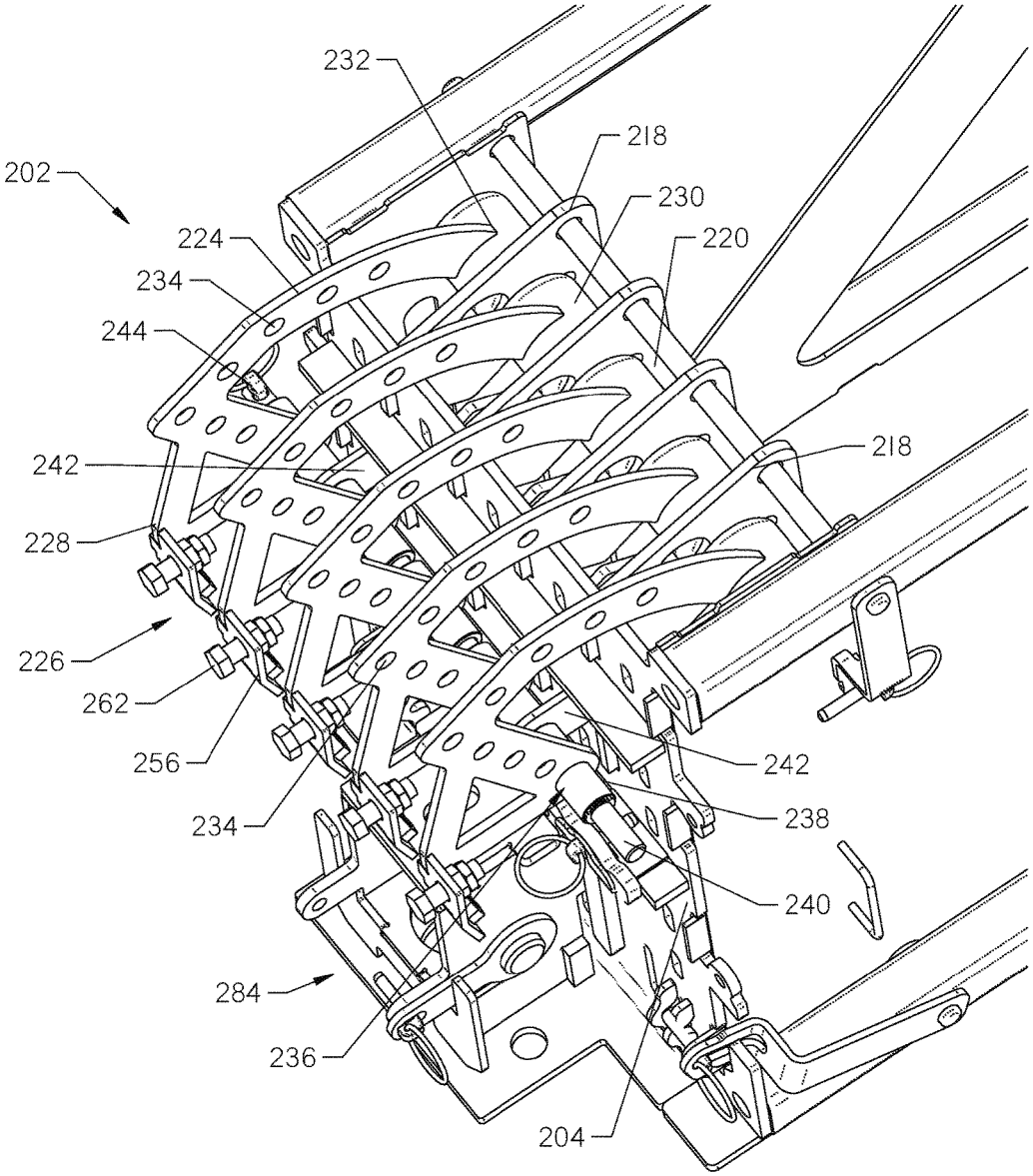
FIG. 12 is a perspective view of the end of the magazine shown in FIG. 11.
Figure 15:
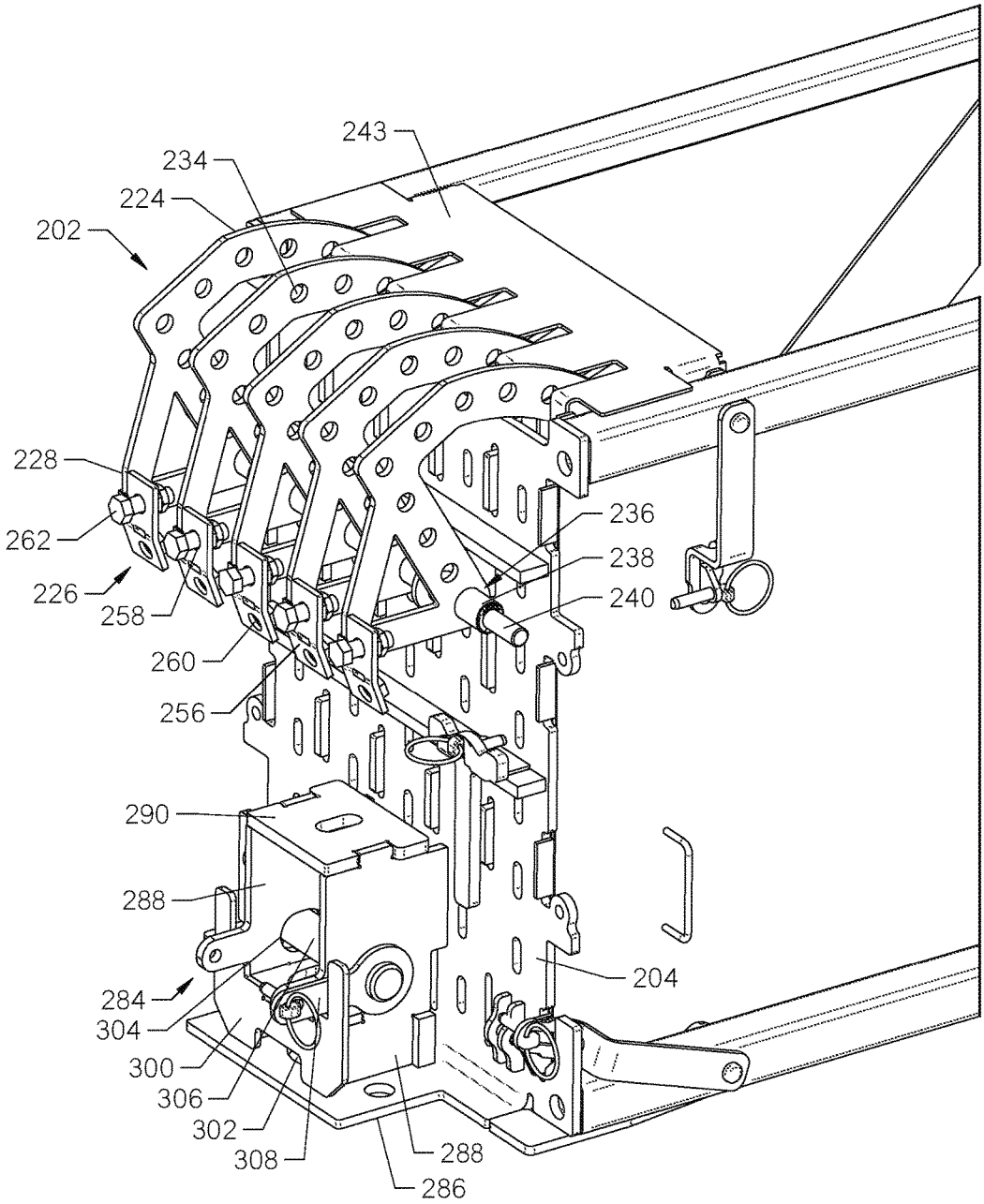
FIG. 15 is a second perspective view of the end of the magazine shown in FIG. 11.

The pivot bar 240 is attached to the first end 204 of the magazine 206 via a set of pivot bar holders 242, shown in FIG. 12. The pivot bar holders 242 each have an opening for receiving the pivot bar 240. The pivot bar 240 is secured in place on the first end 204 of the magazine 206 via a grenade pin 244. Multiple signal elements 202 may be pivotally supported on the pivot bar 240, as shown in FIGS. 12 and 15. A cover 243, shown in FIG. 15, may be placed on top of the dividers 218. The cover 243 helps maintain the spacing of the signal elements 202 on the pivot bar 240. The cover 243 also helps protect and maintain the signal elements 202 within the magazine 206, if the magazine is tilted to extreme angles.

There are preferably the same number of signal elements 202 as columns 220 formed in the magazine 206. The signal elements 202 are supported on the pivot bar 240 such that each first ballast element 230 extends at least partially within a footprint of each column 220. The center of mass of the signal elements 202 is offset from its pivot point 236. The signal elements 202 are movable about the pivot bar 240 between a first position and a second position, as shown in FIGS. 16-17. The first and second positions are vertically offset from one another.

When each column 220 is full of pipe sections 222, the first ballast elements 230 will rest on or engage with the pipe section at the top of each column. This is considered the first position of the signal element 202. Therefore, if a column 220 is full of pipe sections 222, the corresponding signal element 202 is in the first position, as shown in FIG. 16.

When a pipe section 222 is removed from one of the columns 220, gravity will cause the first ballast element 230 to pivot more deeply within the footprint of the corresponding column. This is because the first ballast element 230 is heavier than the target element 226 and the first ballast element 230 can no longer rest on the pipe section 222 at the top of the column 220. This is considered the second position of the signal element 202. Therefore, if a column 220 is not full of pipe sections 222, the corresponding signal element 202 is in the second position, as shown in FIG. 17.

Figure 18:
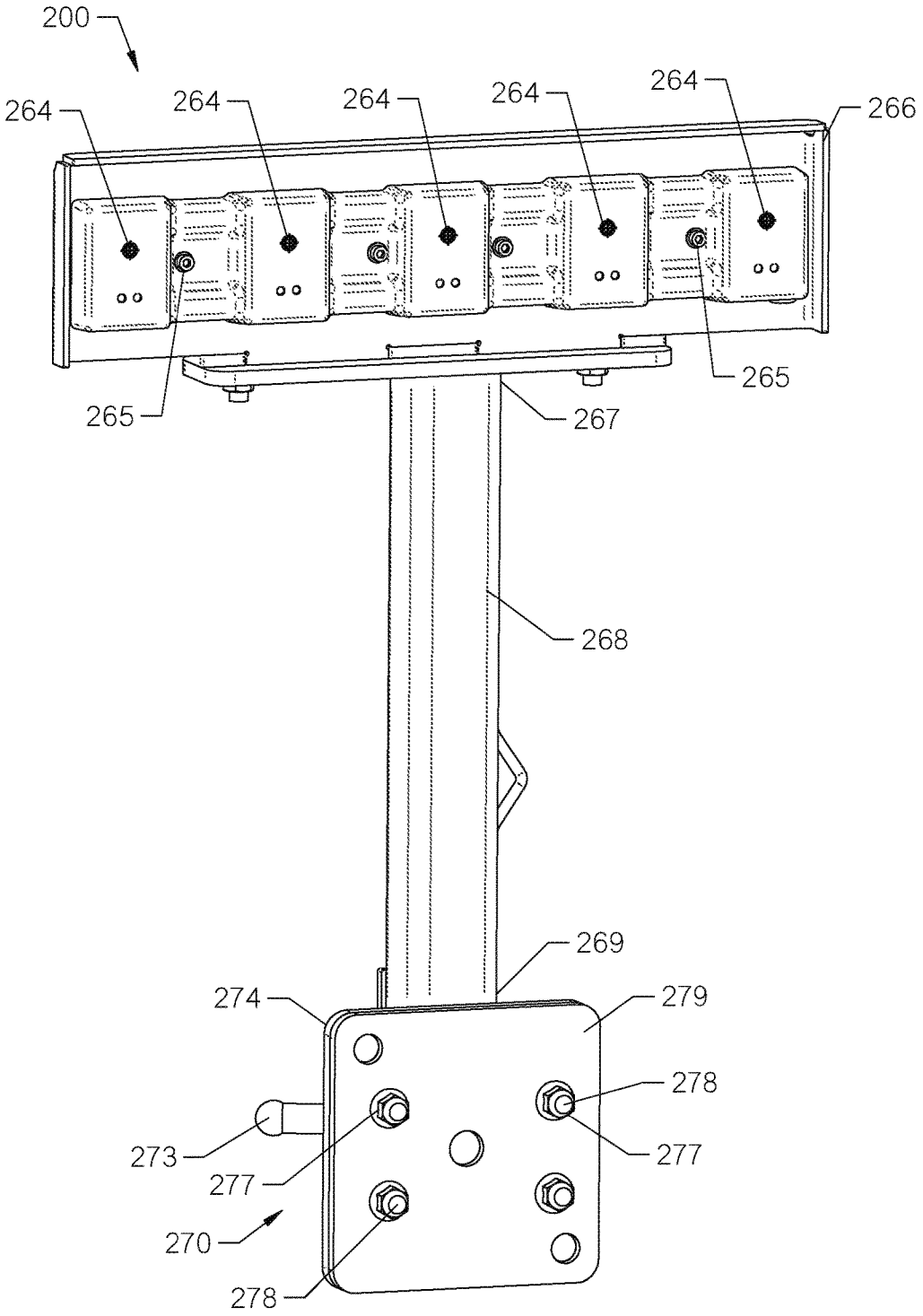
FIG. 18 is a straight on view of an alternative embodiments of the proximity sensor assembly.
Figure 19:
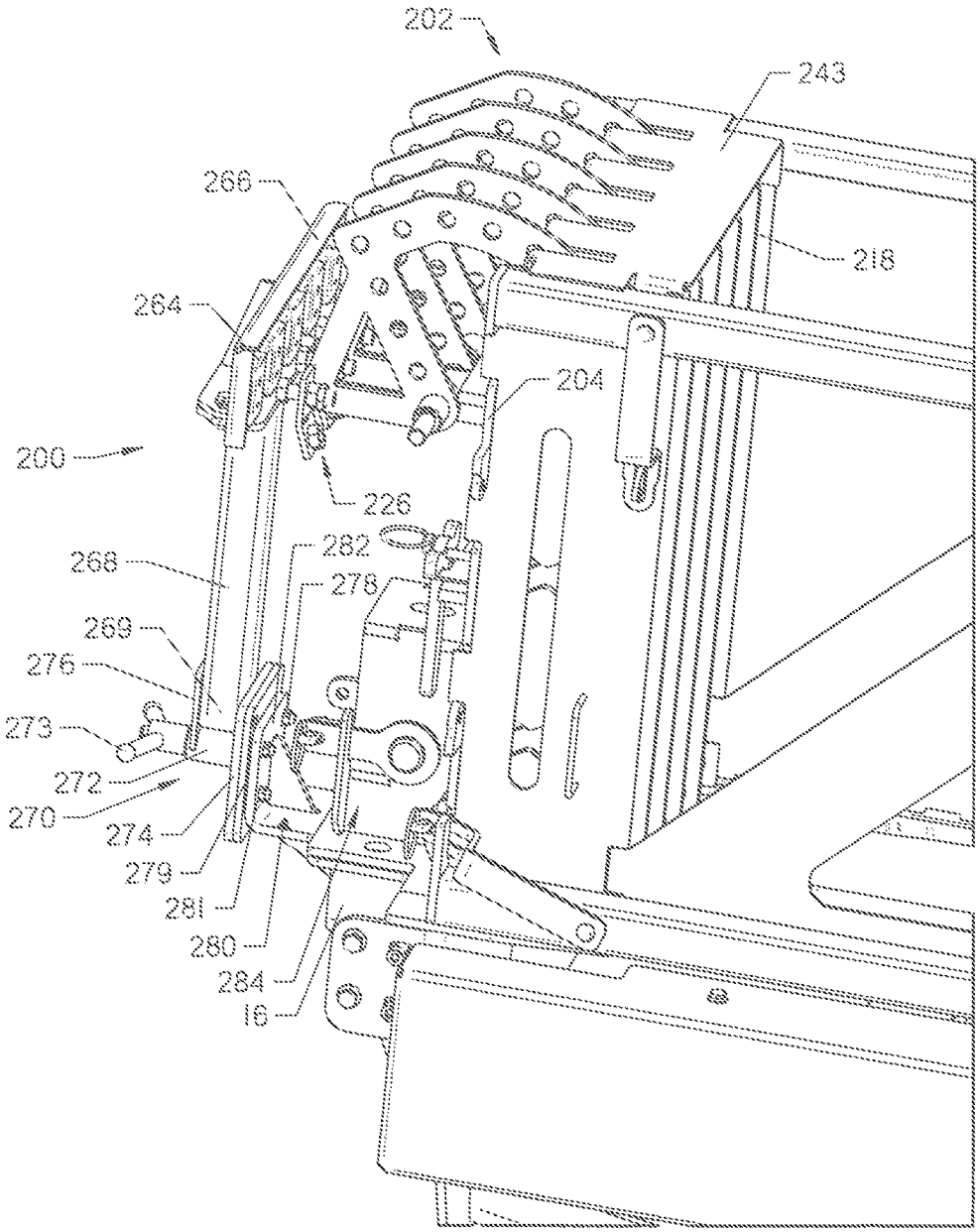
FIG. 19 is a perspective view of the end of the magazine shown in FIG. 11 with the alternative embodiment of the proximity sensor assembly attached to the machine.
Figure 20:
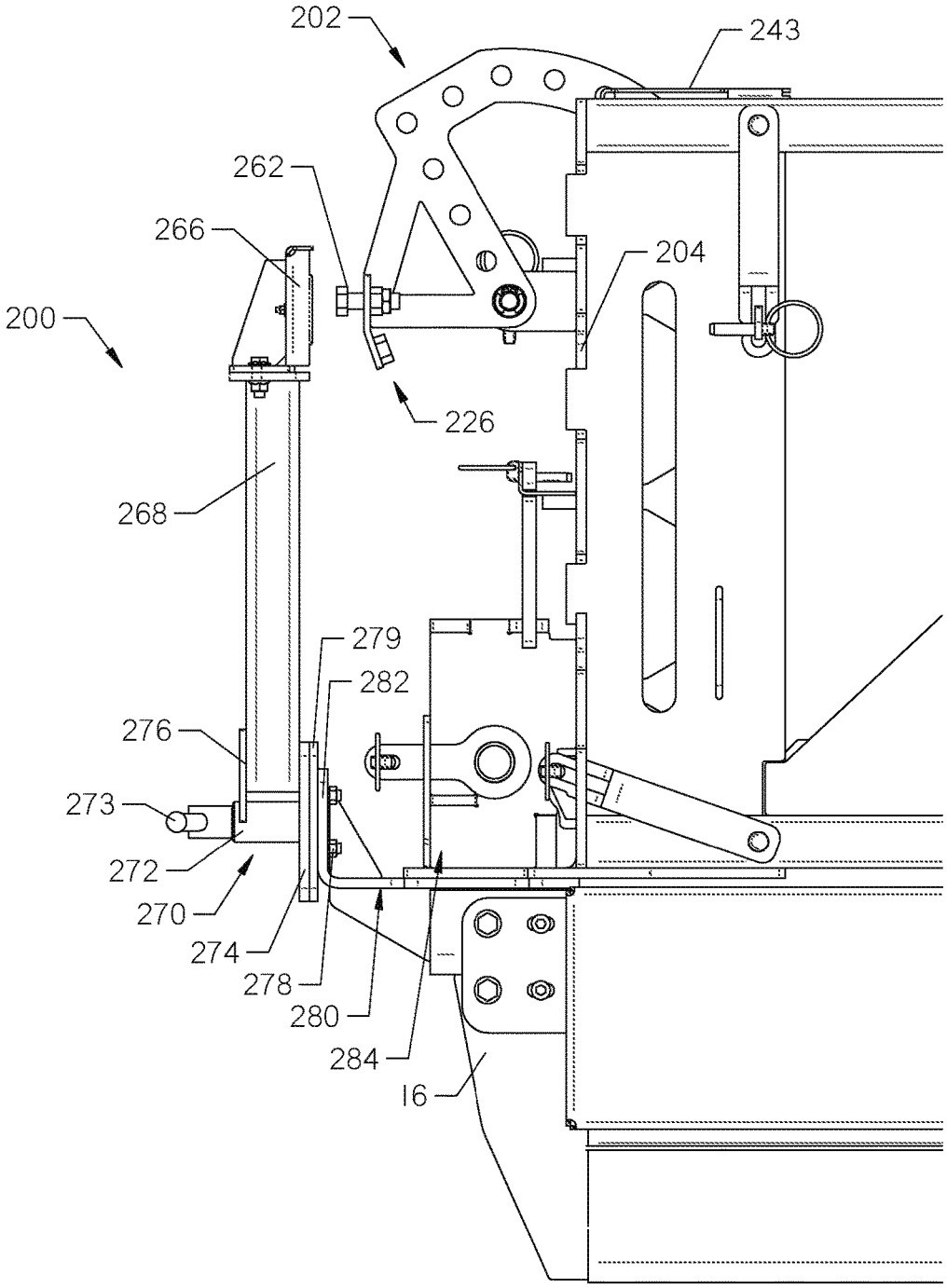
FIG. 20 is a side view of FIG. 19.

Referring now to FIGS. 18-21, the proximity sensor assembly 200 is shown in more detail. The proximity sensor assembly 200 comprises a plurality of sensors 264. The proximity sensor assembly 200 is attached to the frame 16 of machine 10 so that the sensors 264 line up with each target element 226, as shown in FIGS. 19-20 and 26. Preferably, the bolt 262 of each target element 226 is directly in-line with each sensor 264. The bolt 262 may be moved between the top bolt hole 258 and bottom bolt hole 260, depending on which position better aligns the bolt with each sensor 264. The bolt 262 is used to bring the target element 226 closer to each sensor 264, as shown in FIG. 20.

A target element 226 is in-line with a sensor 264 when the signal element 202 is in the first position 246. Thus, when a sensor 264 detects the presence of a target element 226, the corresponding column 220 is full of pipe sections 222. Alternatively, when the signal element 202 is in the second position 248, the target element 226 will pivot upwards and away from the sensor 264, such that the target element 226 is above the first ballast element 230. When this occurs, the sensor 264 will no longer detect the corresponding target element 226. Thus, when a sensor 264 does not detect a target element 226, the corresponding column 220 is not full of pipe sections 222. The proximity sensor assembly 220 will signal the processor on the machine 10 whether it detects the presence of the target element 226. The signals indicate whether or not a given column is full of pipe sections.

The proximity sensor assembly 200 comprises one sensor 264 for each signal elements 202. The sensors 264 are secured in a row to a sensor housing 266 via a plurality of fasteners 265, as shown in FIG. 18. The sensor housing 266 is rectangular in shape and is supported on a first end 267 of a post 268. The post 268 is a solid piece that cannot be adjusted in height. This provides stability to the proximity sensor assembly 200.

A mounting assembly 270 is attached to a second end 269 of the post 268 opposite the sensor housing 266. The mounting assembly 270 is best shown with reference to FIGS. 19-21. The mounting assembly 270 comprises a locking member 272, a mounting plate 274, and a bracket 276. The locking member 272 is disposed below the second end 269 of the post 268. The bracket 276 and the mounting plate 274 are attached to opposite ends of both the post 268 and the locking member 272.

A planar mount 280 is attached to the frame 16 of the machine 10, as shown in FIGS. 19-20. The mount 280 sits underneath the magazine 206 and extends out past the first end 204 of the magazine. The mount 280 has a vertical plate 282. The vertical plate 282 has four bolt holes 281 for receiving bolts 278. A second mounting plate 279 may be attached to the vertical plate 282. The second mounting plate 279 has four bolt holes 277 (FIG. 18) that correspond with bolt holes 281. The second mounting plate 279 is attached to the vertical plate 282 via bolts 278.

The locking member 272 has a bore formed therein for holding a fastener 273. The fastener 273 passes through the locking member 272 and threads into the mounting plate 274 and the second mounting plate 279. This secures the proximity sensor assembly 200 to the planar mount 280.

Figure 21:
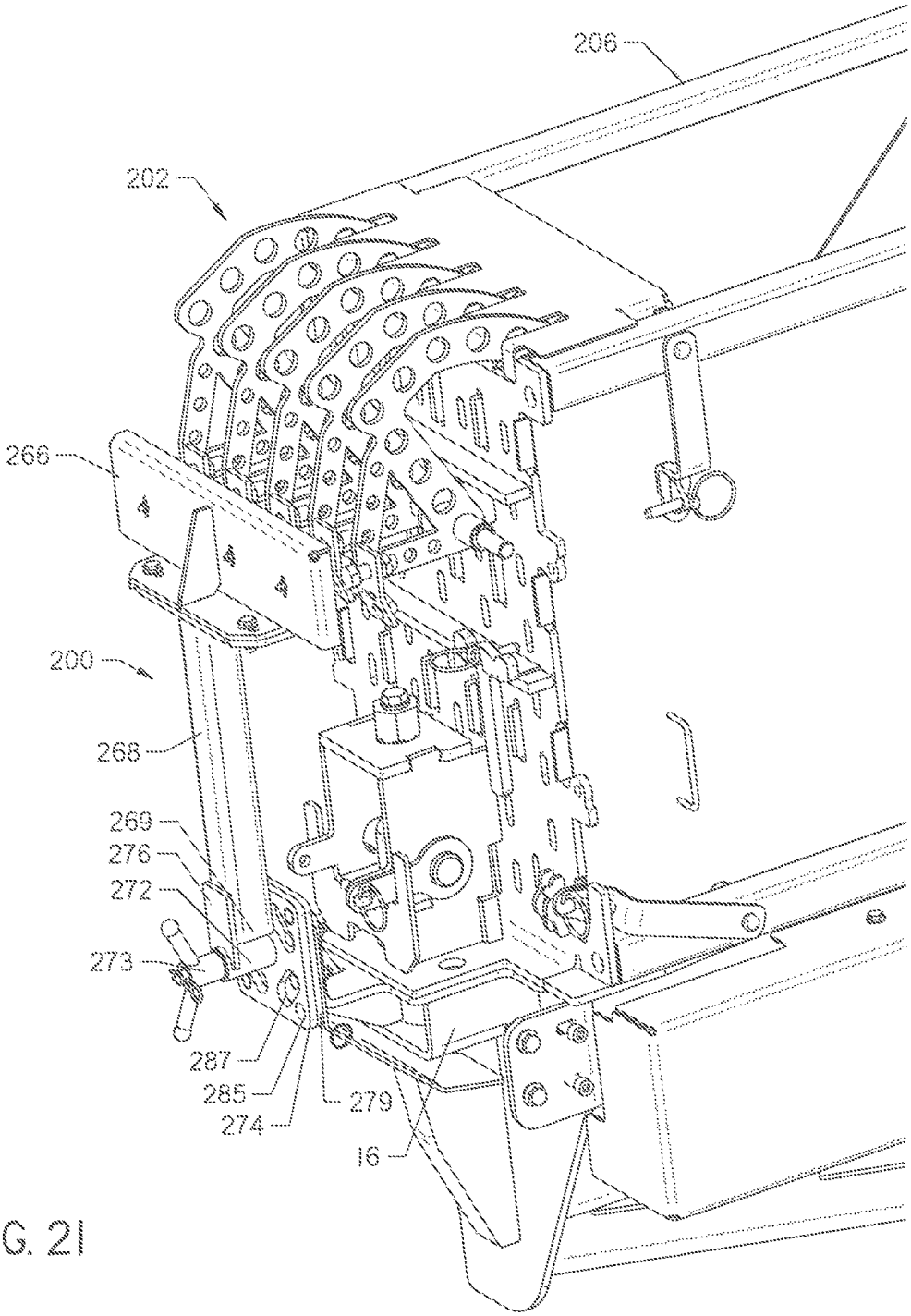
FIG. 21 is an end perspective view of FIG. 19.
Figure 22:
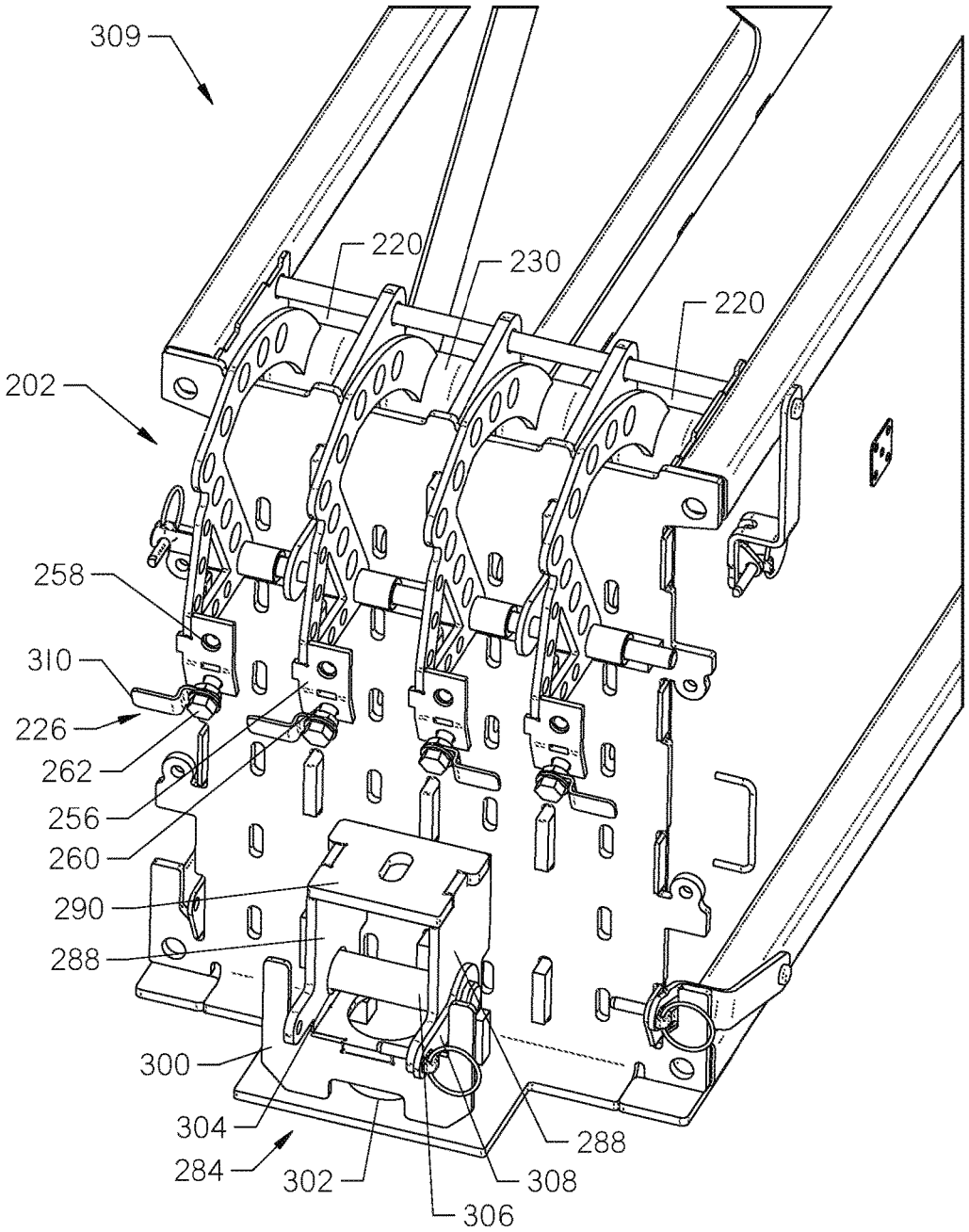
FIG. 22 is a perspective view of an alternative embodiment of the pipe indicators attached to the end of a magazine.

Referring now to FIG. 21, the mounting plate 274 also contains a series of round pins 285 that engage with corresponding holes on the second mounting plate 279. The round pins 285 may prevent the proximity sensor assembly 200 from rotating on the second mounting plate 279.

When the proximity sensor assembly 200 is installed on the machine 10, the fastener 273 may be loosened from the second mounting plate 279. This allows round pins 285 to back off of the second mounting plate 279 and allows the proximity sensor assembly 200 to pivot about the second mounting plate 279. This moves the assembly 200 out of the way, if needed. For example, the assembly 200 may be pivoted 90 degrees while the magazine 206 is secured to the frame 16 of the machine 10.

Once the proximity sensor assembly 200 has been pivoted as desired, the fastener 273 may be re-tightened to retain the proximity sensor assembly 200 in place. The mounting plate 274 also has a series of slots 287 that correspond with the bolts 278. The slots 287 are big enough so that the bolts 278 may fit within the slots 287 when the proximity sensor assembly 200 is pivoted. The fastener 283 may also be completely unthreaded from the second mounting plate 285 to remove the proximity sensor assembly 200 from the machine 10, if needed.

Turning back to FIG. 15, the magazine 206 is secured to the frame 16 of the machine 10 via the locating pin receiver 284. Identical locating pin receivers 284 are each attached to the first end 204 and second end 208 of the magazine 206. The locating pin receiver 284 is substantially identical to the locating pin receiver 96, described with reference to FIGS. 1-10. The pin receiver 284 is supported on a flange 286 extending out from the first end 204 of the magazine 206. The pin receiver 284 comprises a pair of parallel vertical plates 288. A top plate 290 and an end plate 300 are secured to the vertical plates 288 to form a box-like structure. A hole 302 is formed in the flange 286 for receiving a locating pin 98, shown in FIG. 5.

The vertical plates 288 each have a hole 304 formed in them. The locating pin 98 has a hole 114, shown in FIG. 5, that aligns with the holes 304 when the locating pin 98 is in the pin receiver 284. A locking pin 306 may pass through the holes 304 and 114 to secure the locating pin 98 to the locating pin receiver 284. A grenade pin 308 may be used to secure the locking pin 306 in place.

In the embodiment of the proximity sensor assembly 129, shown with reference to FIGS. 1-10, the proximity sensor assembly is supported on the locating pin 98 prior to installation of the magazine 40. Installation of the magazine 40 on the locating pin 98 holds the proximity sensor 129 in position. In the embodiment shown with reference to FIGS. 11-20, the proximity sensor assembly 200 is attached to the frame 16 of the machine 10 rather than the locating pin 98. This provides more stability to the sensor assembly 200.

The magazine 206 shown in FIG. 11 has five columns 220. However, the magazine 206 may have more or less columns 220 depending on the size or number of pipe sections 222 filled within the magazine. For example, a magazine 309, shown in FIG. 22, only has four columns 220. This is because the magazine 309 may be used to hold larger pipe sections. Because there are fewer columns 220 within the magazine 309, the position of the target elements 226 relative the sensors 264 may be changed. Due to this, a tab 310 may be added to the target element 226. The tab 310 provides additional surface area to align the signal elements 202 with the sensors 264.

Figure 23:
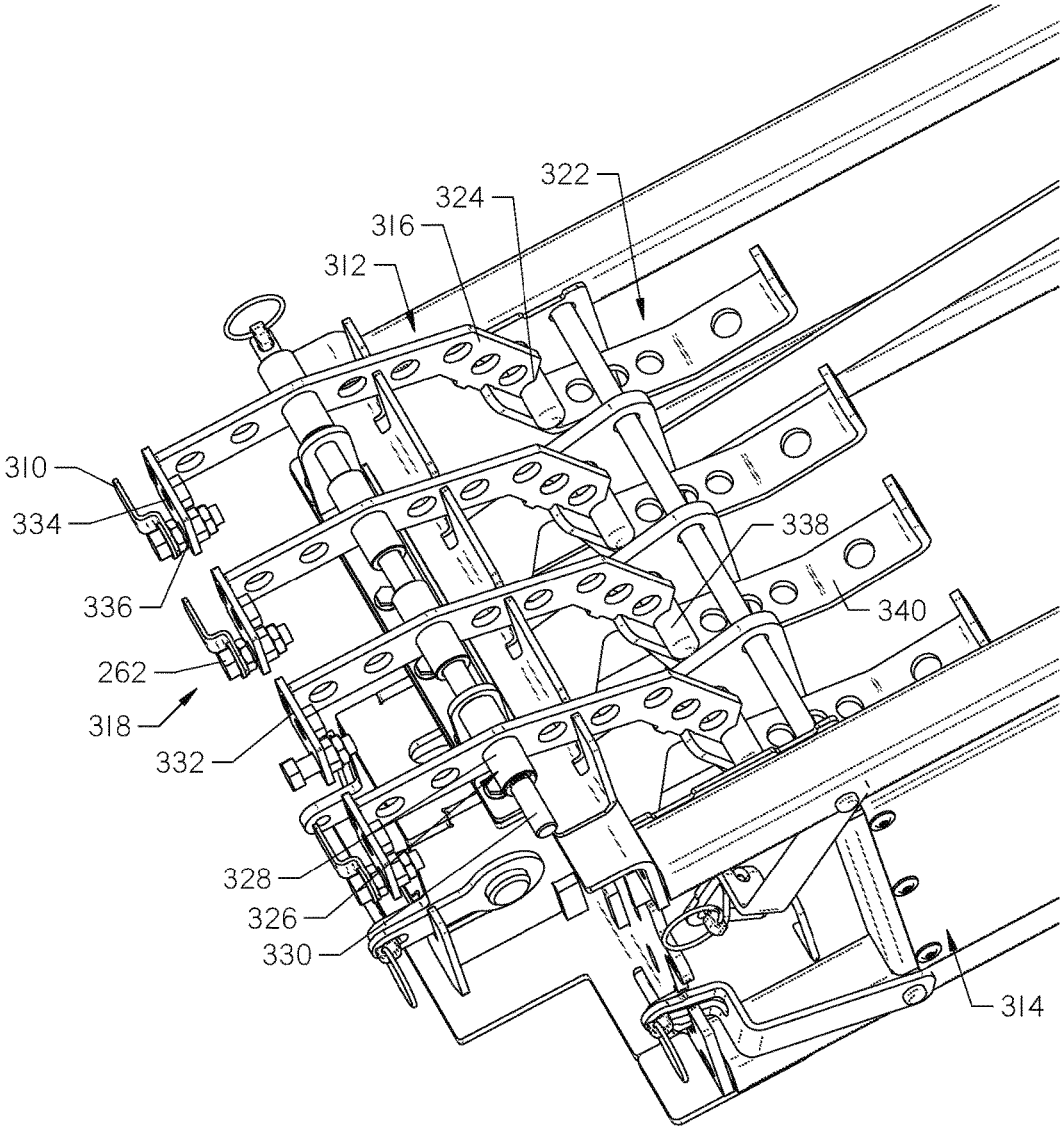
FIG. 23 is a top perspective view of another alternative embodiment of the pipe indicators attached to the end of a magazine.
Figure 24:
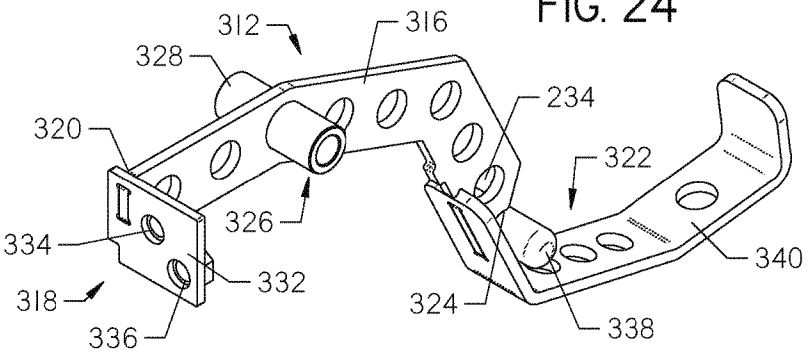
FIG. 24 is a perspective view of one of the pipe indicators of FIG. 22.
Figure 25:
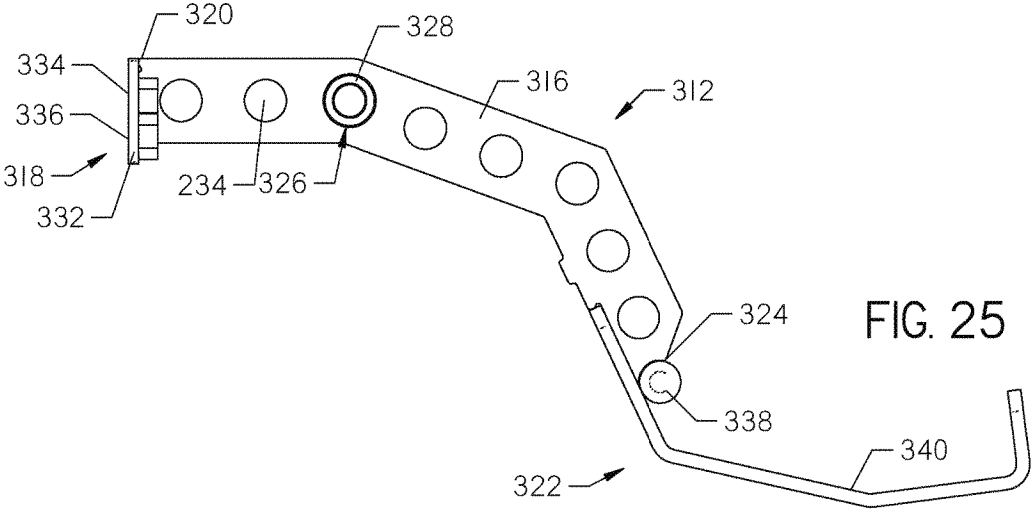
FIG. 25 is a side view of FIG. 23.
Figure 26:
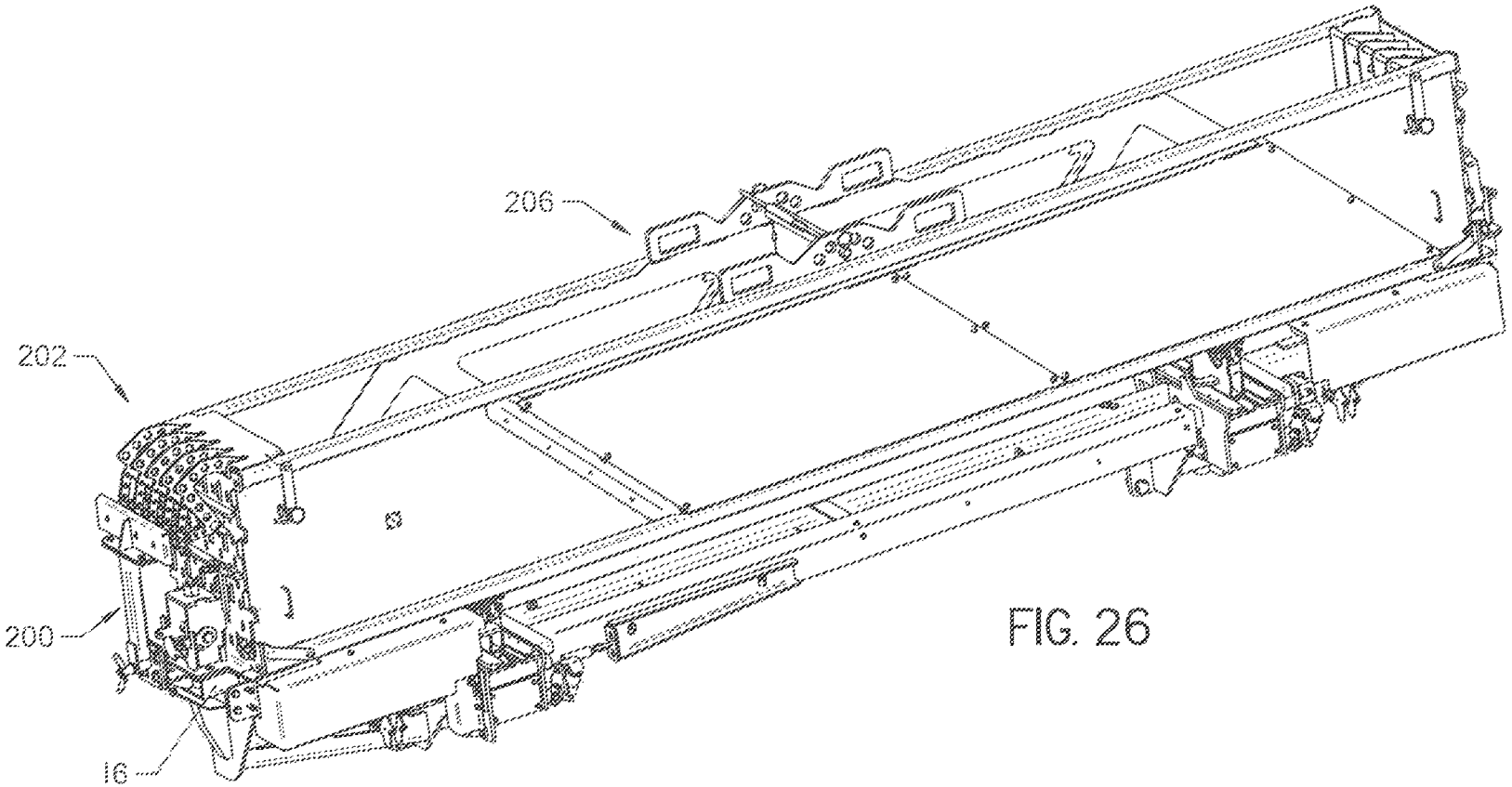
FIG. 26 is a perspective view of the alternative embodiment of the pipe indicators and proximity sensor assembly attached to the end of a magazine.

Referring now to FIGS. 23-25, an alternative embodiment of a signal element 312 is shown. The signal element 312 may be used with a shorter magazine 314. The signal element 312 comprises a frame 316 that is more linear in shape than the frame 224, shown in FIGS. 13-14. The frame 316 still has holes 234 to decrease the weight of the frame. The signal element 312 is also smaller in size than the signal element 202.

The signal elements 312 each comprise a target element 318 attached to its first end 320 and a first ballast element 322 attached to its opposite second end 324. A pivot point 326 is formed on the frame 316 between the target element 318 and the first ballast element 322. The pivot point 326 comprises a cylindrical housing 328 for receiving a pivot bar 330. The height of the pivot bar 330 on the magazine 314 is the substantially the same as the height of the pivot bar 240 on the magazine 206. This allows the same proximity sensor assembly 200 to be used with magazines of varying size.

The target element 318 comprises a plate 332. The plate 332 is a generally square shape and comprises a top bolt hole 334 and a bottom bolt hole 336. The bolt holes 334 and 336 are horizontally and vertically spaced on the plate 332. This provides multiple spacing options to position the bolt 262 so that it aligns with the sensors 264. The plate 256 may also be used with this embodiment. The tab 310 may also be used with the target element 318, as shown in FIG. 23.

The first ballast element 322, shown in FIGS. 23-25, comprises a weight 338 and a planar shoe 340 that projects out past the weight. The weight 338 is a generally cylindrical shape, but is smaller than the weight attached to the signal element 202. The weight 338 helps guide the signal elements 312 between the first and second position and keep appropriate spacing within the dividers 218. The shoe 340 may be used to provide additional surface area to the first ballast element 322 to better engage with the pipe sections 222 in the magazine 314. The size and shape of the shoe may vary as needed.

It should be appreciated by those skilled in the art that various modifications and variations can be made in the present invention without departing from the scope and spirit of the invention. It is intended that the present invention cover such modifications and variations as come within the scope and spirit of the appended claims and their equivalents.

What is claimed is:

1. A system, comprising:

a magazine defining spaced and parallel first and second external faces and having structure forming at least one interior column that extends between the faces; and at least one movable signal element attached to the magazine adjacent its first face and extending at least partially within a footprint of one and only one interior column, in which the at least one signal element has a pivot point and is pivotally supported by the magazine at its pivot point.

2. The system of claim 1 wherein the structure within the magazine forms a plurality of interior columns and in which the at least one signal element is a plurality, equal in number to the interior columns, each signal element extending at least partially within a footprint of one and only one interior column.

3. The system of claim 2 wherein each signal element is characterized by a target element and a first ballast element and is movable between a first position and a second position, each first ballast element remaining within the footprint of its associated one and only one interior column at both the first and second positions of its signal element.

4. The system of claim 3 in which the target element is positioned above the first ballast element when that signal element is in the second position.

5. The system of claim 3, further comprising:

at least one sensor, responsive to a proximity of the target element of one and only one signal element;

wherein the target element of the one and only one signal element is situated closer to the at least one sensor when that signal element is in its first position, as compared to its second position.

6. The system of claim 5 in which the target element of the one and only one signal element is positioned out of face-to-face alignment with the at least one sensor when that signal element is in its second position.

7. The system of claim 5 wherein one of the interior columns of the magazine is completely filled with pipe sections and the target element of one and only one signal element associated with that interior column is positioned in face-to-face alignment with the at least one sensor.

8. The system of claim 5 wherein one of the interior columns of the magazine is either empty or less than completely filled with pipe sections and the target element of the one and only one signal element associated with that interior column is positioned out of face-to-face alignment with the at least one sensor.

9. The system of claim 5 wherein the at least one sensor is a plurality, equal in number to the signal elements.

10. The system of claim 1 wherein the magazine has the shape of a right rectangular prism.

11. The system of claim 1 wherein the pivot point of the at least one signal element is situated outside the footprint of its associated one and only one interior column.

12. The system of claim 1 wherein the at least one interior column is rectilinear.

13. The system of claim 1 wherein a center of mass of the at least one signal element is offset from its pivot point.

14. The system of claim 1 wherein the at least one signal element is at least partially arcuate in shape.

15. The system of claim 1, further comprising:

a horizontal boring machine having one or more platform surfaces upon which the magazine is supported.

16. The system of claim 1 wherein the at least one interior column opens at a base of the magazine.

17. A horizontal boring machine comprising:

a frame having a first end and a second end;

a carriage supported on the frame and movable between the first end of the frame and the second end of the frame; and the apparatus of claim 1 supported on the frame.

18. A system, comprising:

a magazine defining spaced and parallel first and second external faces and having structure forming at least one interior column that extends between the faces; and at least one movable signal element attached to the magazine adjacent its first face and extending at least partially within a footprint of one and only one interior column, in which the at least one signal element has a pivot point situated outside the footprint of its associated one and only one interior column and is pivotally supported by the magazine at its pivot point.

19. A system, comprising:

a magazine defining spaced and parallel first and second external faces and having structure forming a plurality of interior columns that extend between the faces;

a plurality of movable signal elements, equal in number to the interior columns, attached to the magazine adjacent its first face, each signal element extending at least partially within a footprint of one and only one interior column;

in which each signal element is characterized by a target element and a first ballast element and is movable between a first position and a second position, each first ballast element remaining within the footprint of its associated interior column at both the first and second positions of the signal element, and in which each signal element is supported by the magazine at a pivot point, and in which the target element of one and only one signal element is positioned above the first ballast element when that signal element is in the second position; and at least one sensor, responsive to a proximity of the target element of one and only one signal element;

wherein the target element of the one and only one signal element is situated closer to the at least one sensor when that signal element is in its first position, as compared to its second position.

20. The system of claim 19 in which the target element of the one and only one signal element is positioned out of face-to-face alignment with the at least one sensor when that signal element is in its second position.

21. The system of claim 19 in which the one of the interior columns of the magazine is completely filled with pipe sections and the target element of one and only one signal element associated with that interior column is positioned in face-to-face alignment with the at least one sensor.

22. The system of claim 19 in which one of the interior columns of the magazine is either empty or less than completely filled with pipe sections and the target element of one and only one signal element associated with that interior column is positioned out of face-to-face alignment with the at least one sensor.

23. The system of claim 19 wherein the at least one sensor is a plurality, equal in number to the signal elements.

* * * * *